US006158252A

United States Patent [19]

Conti

[11] Patent Number: 6,158,252

[45] Date of Patent: Dec. 12, 2000

[54] METHOD AND SINGLE-CYLINDER MACHINE FOR PRODUCING SOCKS AND THE LIKE, FOR THE AUTOMATIC CLOSURE OF THE FINAL END OF A TUBULAR KNITTED FABRIC SUCH AS A SOCK

[75] Inventor: Paolo Conti, Firenze, Italy

[73] Assignee: Golden Lady S.P.A., Italy

[21] Appl. No.: 09/308,763

[22] PCT Filed: Feb. 24, 1998

[86] PCT No.: PCT/IT98/00037

§ 371 Date: May 21, 1999

§ 102(e) Date: May 21, 1999

[87] PCT Pub. No.: WO98/38367

PCT Pub. Date: Sep. 3, 1998

[30] Foreign Application Priority Data

Feb. 26, 1997 [IT] Italy ..... FI97A0033

[51] Int. Cl.[7] ..... D04B 9/40

[52] U.S. Cl. ..... 66/148; 66/149 S

[58] Field of Search ..... 66/147, 148, 149 S, 66/149 R, 150

[56] References Cited

U.S. PATENT DOCUMENTS

| | | | |
|---|---|---|---|
| 4,028,910 | 6/1977 | Wignall et al. | 66/148 |
| 4,407,145 | 10/1983 | Lonati | 66/149 S |
| 5,551,260 | 9/1996 | Frullini et al. | 66/148 |
| 5,647,229 | 7/1997 | Conti | 66/148 |
| 5,727,400 | 3/1998 | Lonati et al. | 66/148 |
| 5,924,309 | 7/1999 | Conti | 66/148 |

*Primary Examiner*—Danny Worrell
*Attorney, Agent, or Firm*—McGlew and Tuttle, P.C.

[57] ABSTRACT

On the disc (5) carrying the hooks (7) are two concentric pipes (12, 14) for tensioning the tubular fabric and for inverting it at the conclusion of the formation of the article. To close the toe: the loops of half of the needles (3A) are loaded onto the corresponding hooks (7A) and a first non-run lip (21) is formed and released onto the hooks (7A); the needles (3B) of the other half of the needles are used to form a second non-run lip (23) which is then transferred to the fabric-free needles (3A) of the opposite half, which engage the fabric along the second non-run lip (21) is passed from the hooks (7A) to the needles (3A), and a third non-run lip (25) is formed.

18 Claims, 26 Drawing Sheets

METHOD AND SINGLE-CYLINDER MACHINE FOR PRODUCING SOCKS AND THE LIKE, FOR THE AUTOMATIC CLOSURE OF THE FINAL END OF A TUBULAR KNITTED FABRIC SUCH AS A SOCK

SUMMARY AND OBJECTS OF THE INVENTION

The object of the invention is to automate the closure of the toe, i.e. the end of a tubular article, at the conclusion of the knitting of the said article and on the same single-cylinder machine on which the latter was produced.

The invention relates firstly to a single-cylinder sock machine with a hook disc, for closing the toe at the conclusion of the formation of the tubular fabric, which machine is characterized in that it comprises: on the hook disc, means for drawing the tubular fabric to the opposite side of the disc from the needle cylinder; a mechanism for transferring the fabric released by the needles of one semicircle to the fabric-free needles of the opposite semicircle of the cylinder; and means for operating the disc hooks corresponding to the needles of the said opposite semicircle in order to take the loops from the corresponding needles.

For tensioning, at least one pipe may pass through the disc for pneumatic suction of the tubular fabric. Advantageously there are two concentric suction pipes, a first or inner circular-sectioned pipe and a second or outer annular-sectioned pipe, which pass through the disc; and means for switching the suction from one of the said two pipes to the other; this produces tensioning in the second pipe and then inverts the article of tubular fabric by transferring it from the second pipe to the first pipe.

The invention also relates to a method for carrying out the automatic closure of the toe at the final end of the tubular fabric of a sock or other such article, in a single-cylinder knitting machine with a hook disc.

According to this method the developing tubular fabric is drawn upwards, and at the conclusion of the formation of the article and in order to close its toe:

- the hooks are loaded with the loops of a first half of the cylinder needles;
- a first non-run lip is formed with the said first half of the needles, which then release the loops of a first half of the final end of the tubular fabric;
- a second non-run lip is formed with the needles of the second half of the cylinder needles, which then release the loops of the second half of the said final end;
- the said second half of the said final end with its non-run lip is transferred to the needles of the first half of the cylinder needles and the said needles are raised in order to engage the fabric along the second non-run lip;
- the said hooks corresponding to the first half of the needles are moved radially out, and the said needles are operated to take the fabric from the hooks and join it to the fabric already engaged by the said needles;
- and a third non-run lip is formed and then released by the needle.

The developing tubular fabric is advantageously tensioned pneumatically in a pneumatic suction pipe passing through the disc. The developing tubular fabric can be tensioned pneumatically in an annular-sectioned suction pipe surrounding an inner pipe, and at the conclusion of the closure of the final end of the tubular article, the suction is switched from the annular-sectioned outer pipe to the inner pipe, so that the tubular article closed and released by the needles is sucked with the three non-run lips into the inside of the article, which is thus straightened out before being released by the needles.

Other features of the invention are defined in the accompanying claims.

The various features of novelty which characterize the invention are pointed out with particularity in the claims annexed to and forming a part of this disclosure. For a better understanding of the invention, its operating advantages and specific objects attained by its uses, reference it made to the accompanying drawings and descriptive matter in which preferred embodiments of the invention are illustrated.

Figure 1:
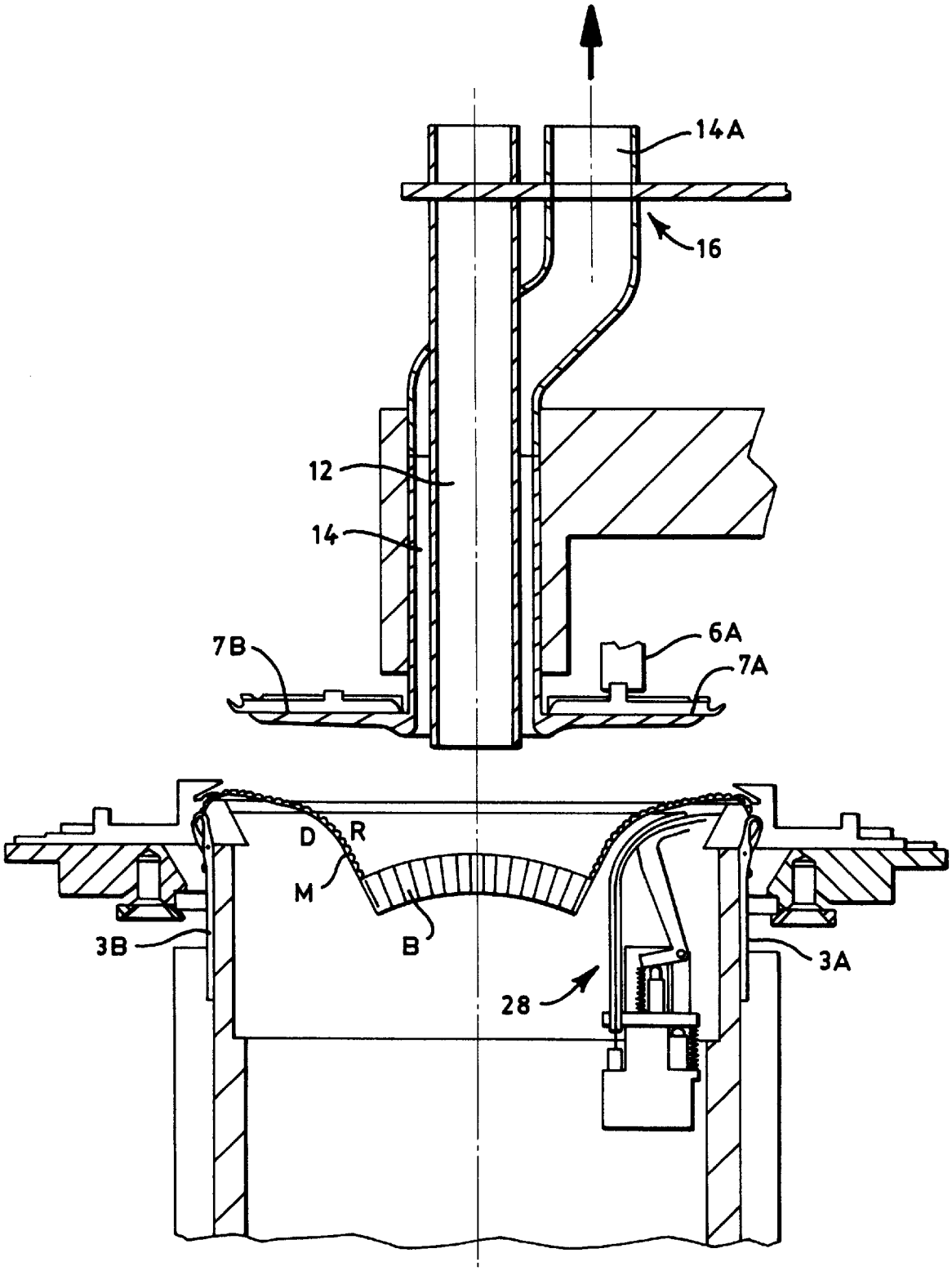
FIGS. 1 to 5 show, in axial section, the disc and part of the cylinder in various stages of the process.

In the version illustrated in FIGS. 1 to 16 of the accompanying drawing, the numeral 1 denotes the needle cylinder (of which the top end is shown), 3 denotes the needles, 5 denotes the coaxial disc situated above the needle cylinder and containing the radially moving hooks 7A, 7B; 6A (FIGS. 1, 3) and 6B (FIGS. 4, 11) denote means for operating each 7A of the hooks, for their radial movement, for reasons indicated later. The numeral 9 denotes the sinkers that move radially at the upper end of the needle cylinder. The hooks 7A are in one semicircle of the disc, and the hooks 7B in the opposite semicircle.

In the center of the disc 5 is an inner pipe 12 and an outer pipe 14, the latter being of annular section and surrounding the pipe 12. At a distance from the disc is a device 16 for switching the suction from the pipe 12 to the pipe 14 and vice versa. This device 16 may comprise a slide valve or rotary valve, or two control valves for the two pipes 12 and 14A, the latter pipe being a continuation of the annular-sectioned pipe 14.

Figure 2:
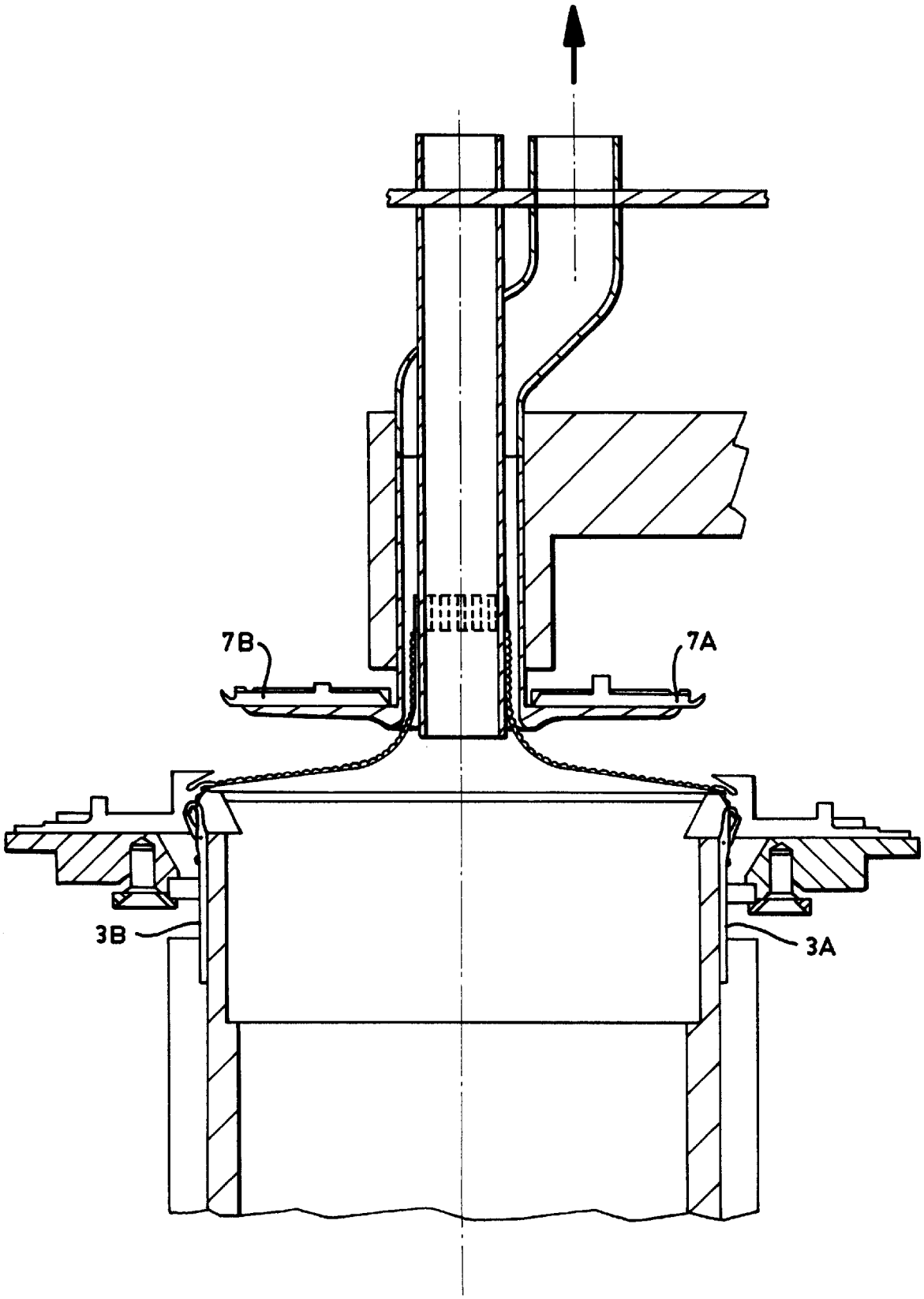

At the start of the process (FIG. 1), the initial edge B of the tubular article is produced, after which work commences on the tubular article M, of which the face D is downmost and the reverse R uppermost when viewing FIG. 1. The device 16 is set for suction in the annular-sectioned pipe 14. Consequently as the article M is gradually produced it is drawn up into the pipe 14, i.e. around the outside of the pipe 12, as shown in FIG. 2; the article M in the pipe 14 is therefore reverse side out.

Figure 6:
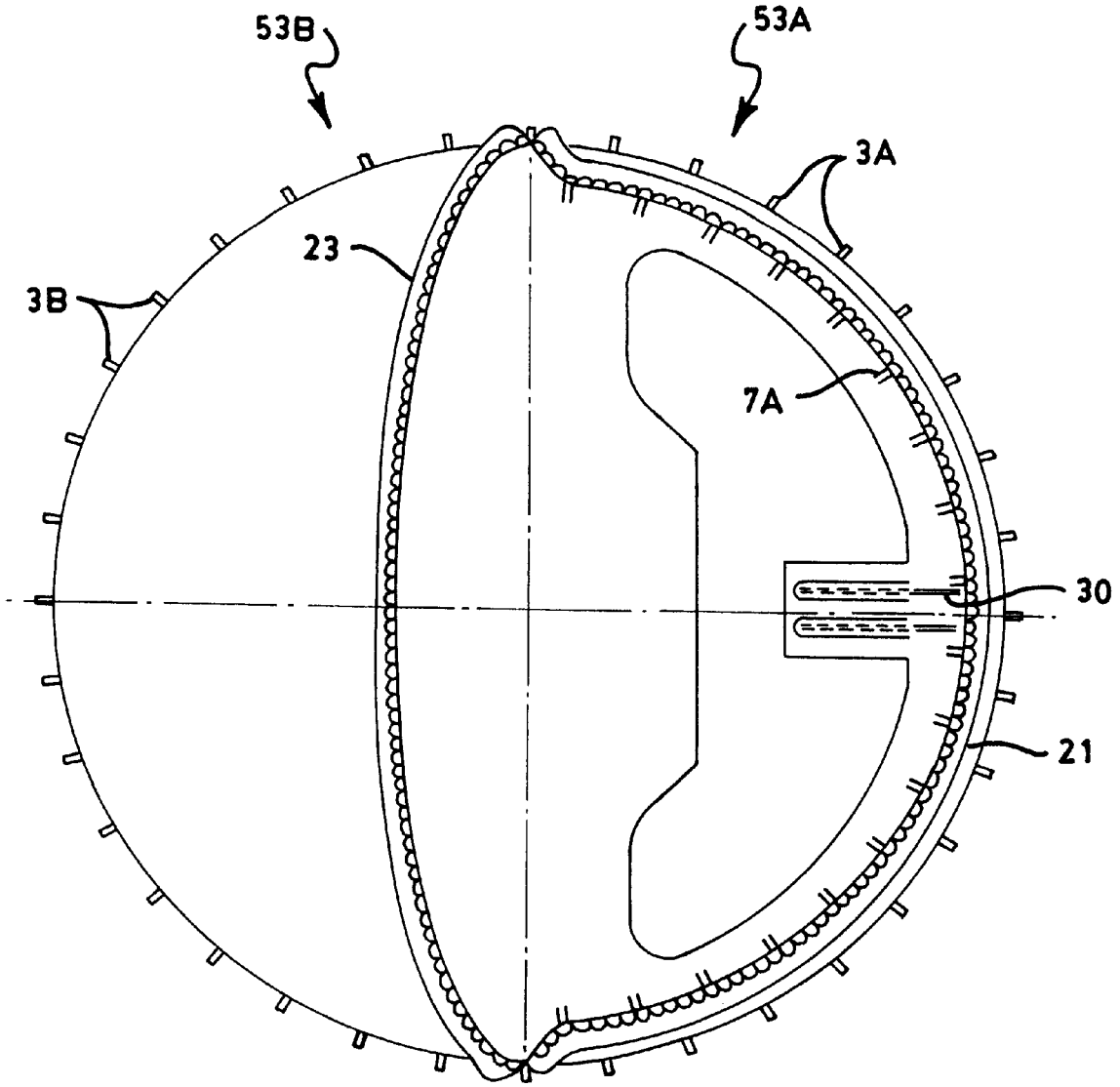
FIG. 6 shows a plan view basically on VI—VI as marked in FIG. 5.

Turning also to FIG. 6, the needles 3 are divided into needles 3A around a semicircle denoted S3A and needles 3B around a semicircle S3B. The hooks 7 are similarly divided into hooks 7A on one semicircle denoted S7A and hooks 7B on a second semicircle denoted S7B.

Figure 3:
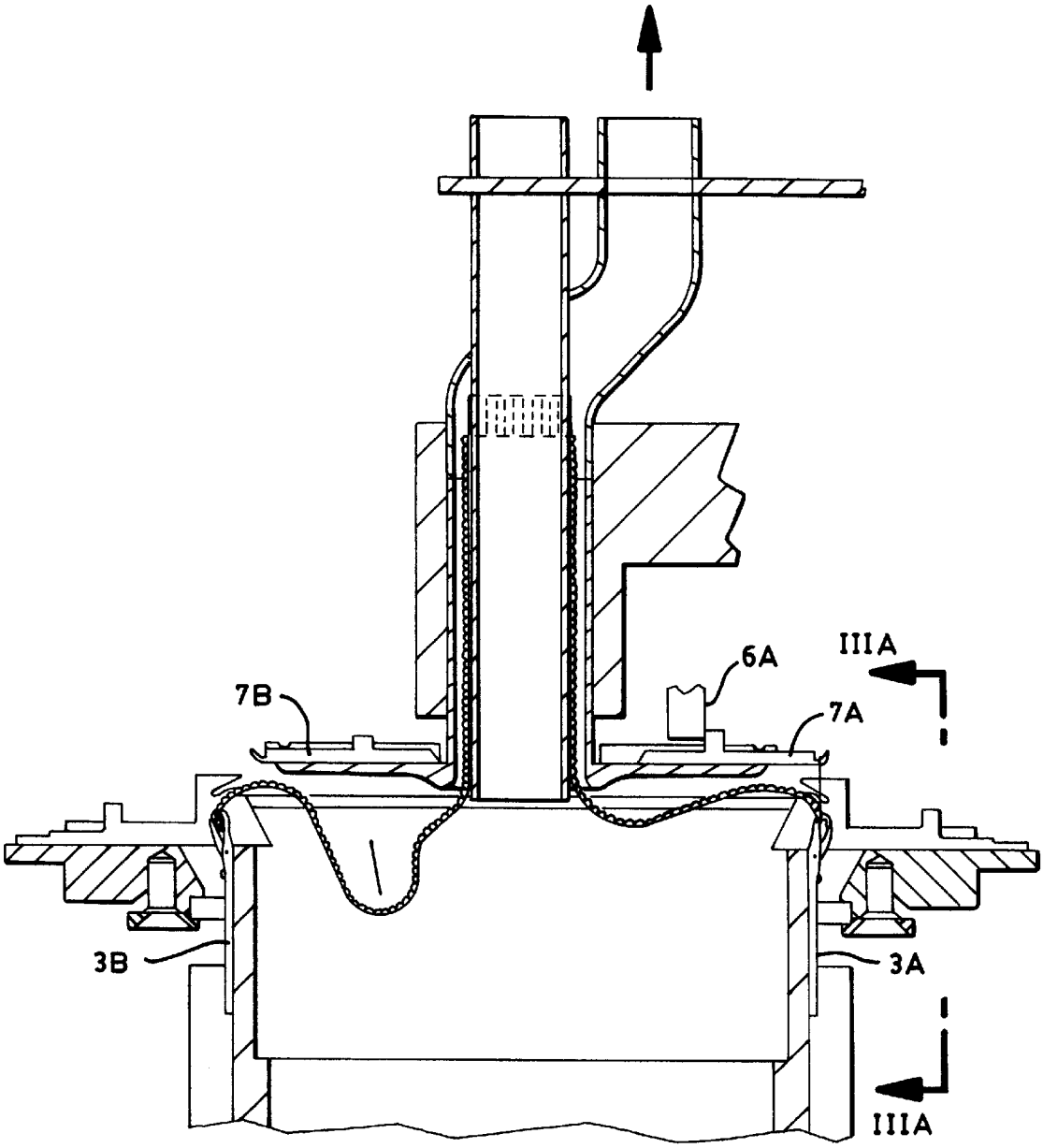
Figure 3A:
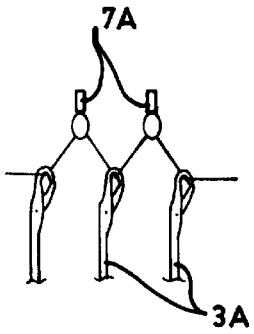
FIG. 3A being a view on IIIA—IIIA as marked in FIG. 3.

Once the tubular article M has been prepared, it is swung from the position of FIG. 1 to that of FIG. 2 and so reaches the position shown in FIG. 3 as work continues, where it can even be partly accumulated in the upper end of the annular-sectioned pipe 14, held below the device 16 which has a suitable retaining grid 16A.

Figure 4:
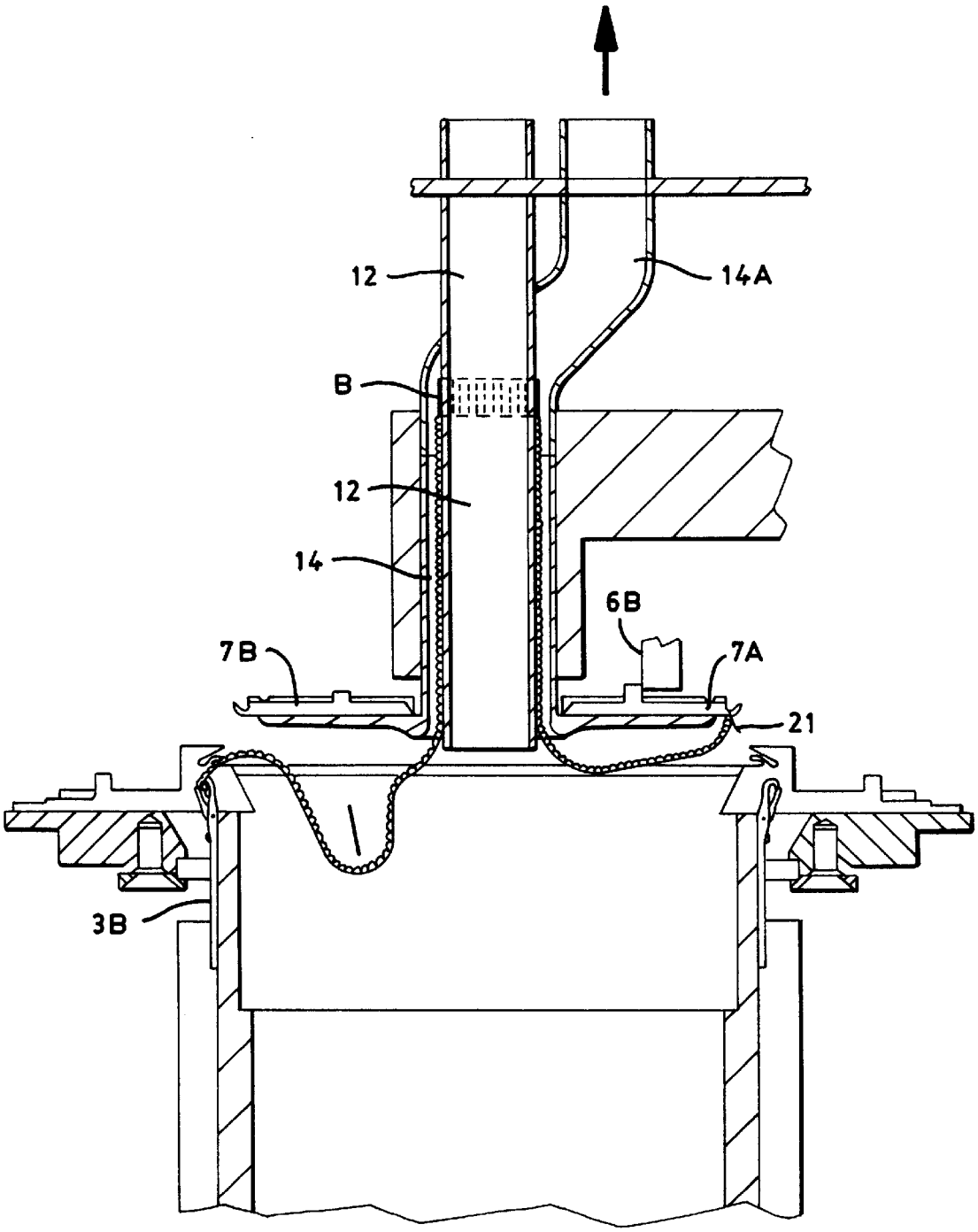
Figure 5:
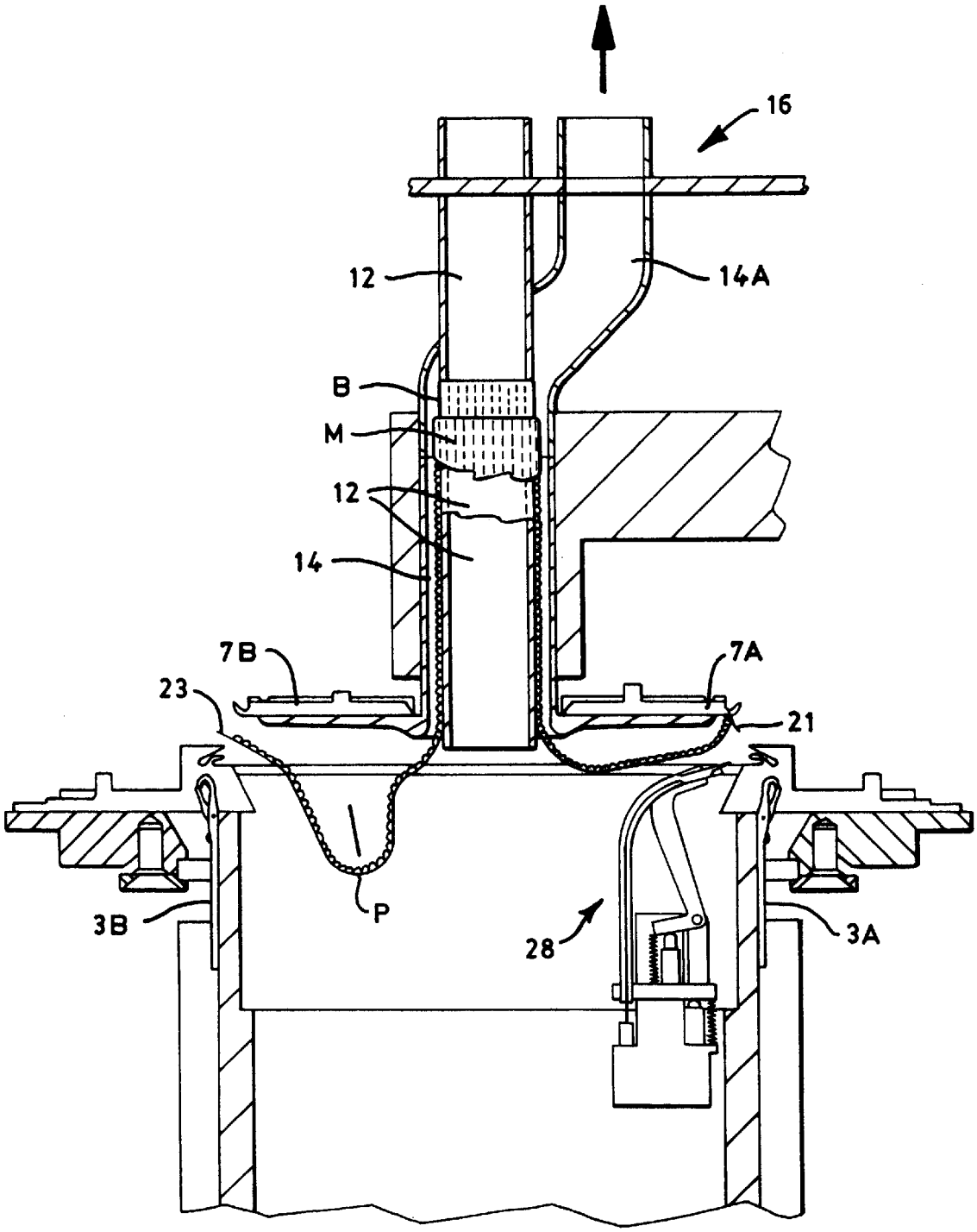

At the conclusion of the formation of the tubular article M, a pouch P is formed from which the toe is to be made, while a pouch for the heel may have been formed previously. After the pouch P has been made for the toe, the hooks 7A are extended radially so as to become loaded with the loops MA (FIG. 3) of the fabric M around the arc of needles S3A; a first non-run lip 21 is then formed and, when released by the needles 3A, remains engaged on the hooks 7A, which are returned into the disc 5 as shown in FIGS. 4 and 5. Around the arc S3B the needles 3B are operated to form a second non-run lip 23, which is then released by the needles 3B of the arc S3B as shown in FIG. 5; in this way the fabric formed by the needles 3B (which also includes the pouch P) is released and the article assumes the position schematically shown in FIG. 5.

Figure 7:
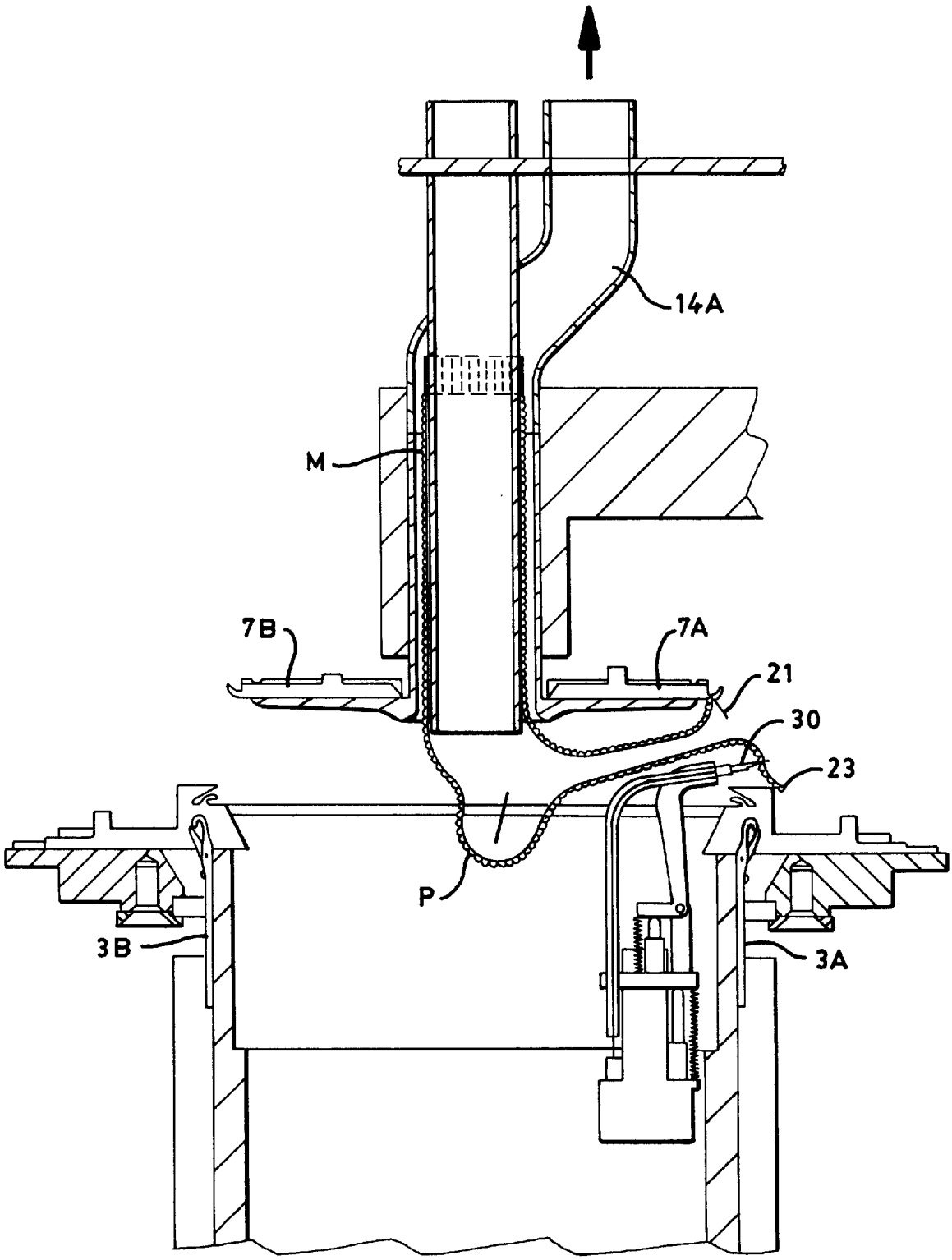
FIGS. 7 to 16, show, in a similar way to FIGS. 1 to 5, other stages in the process, FIG. 14A being an enlarged detail of FIG. 14.
Figure 8:
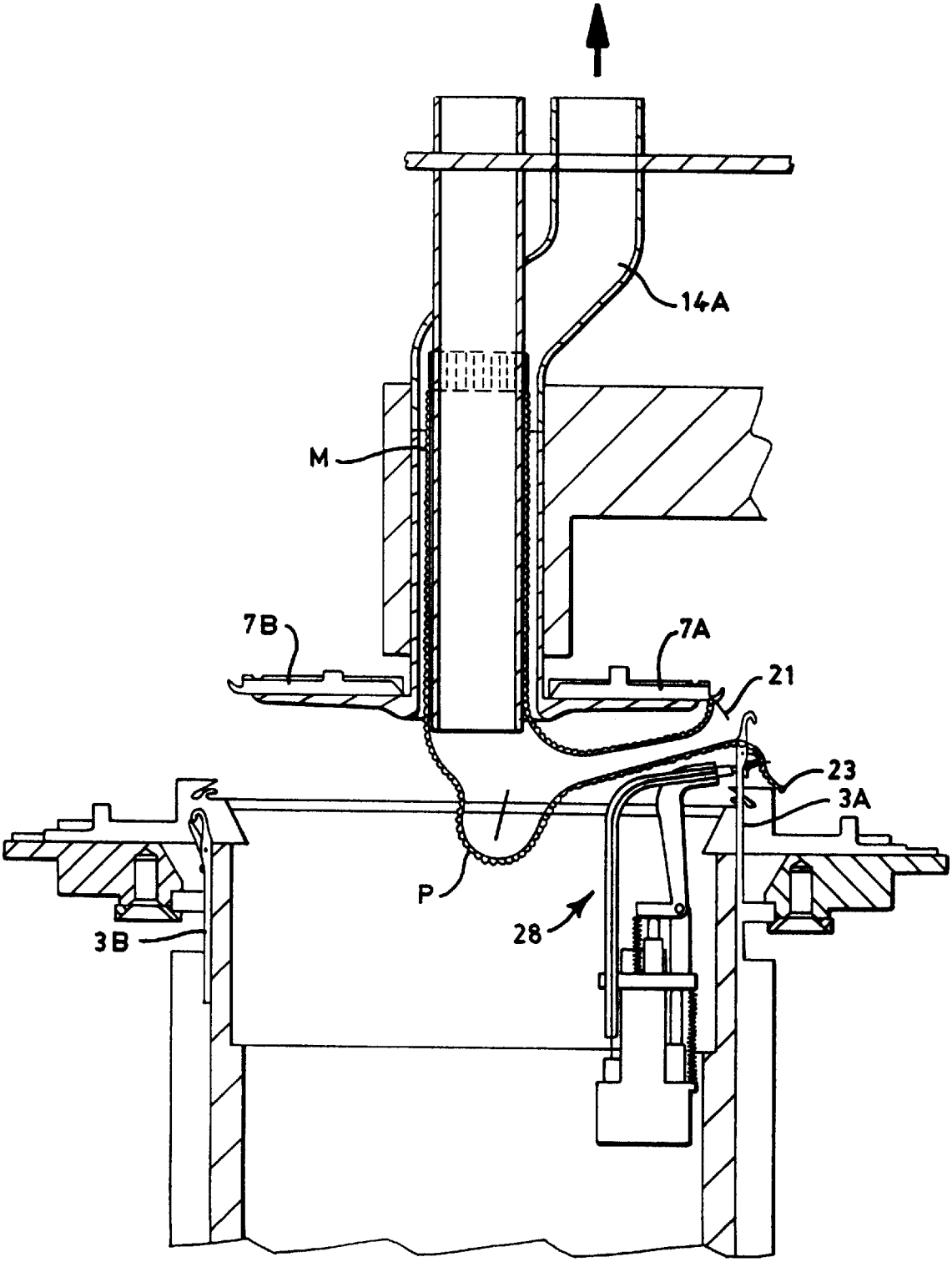
Figure 9:
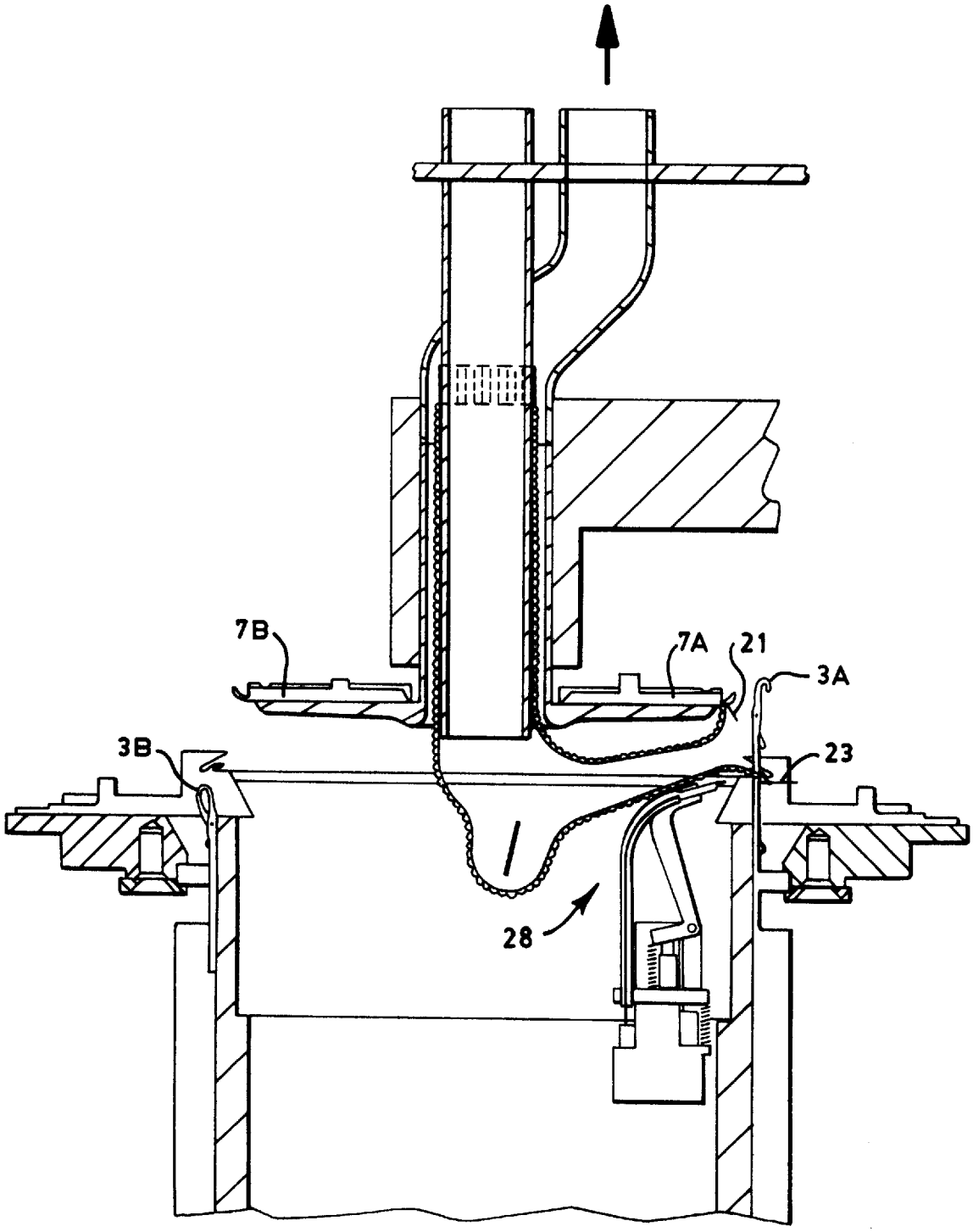
Figure 10:
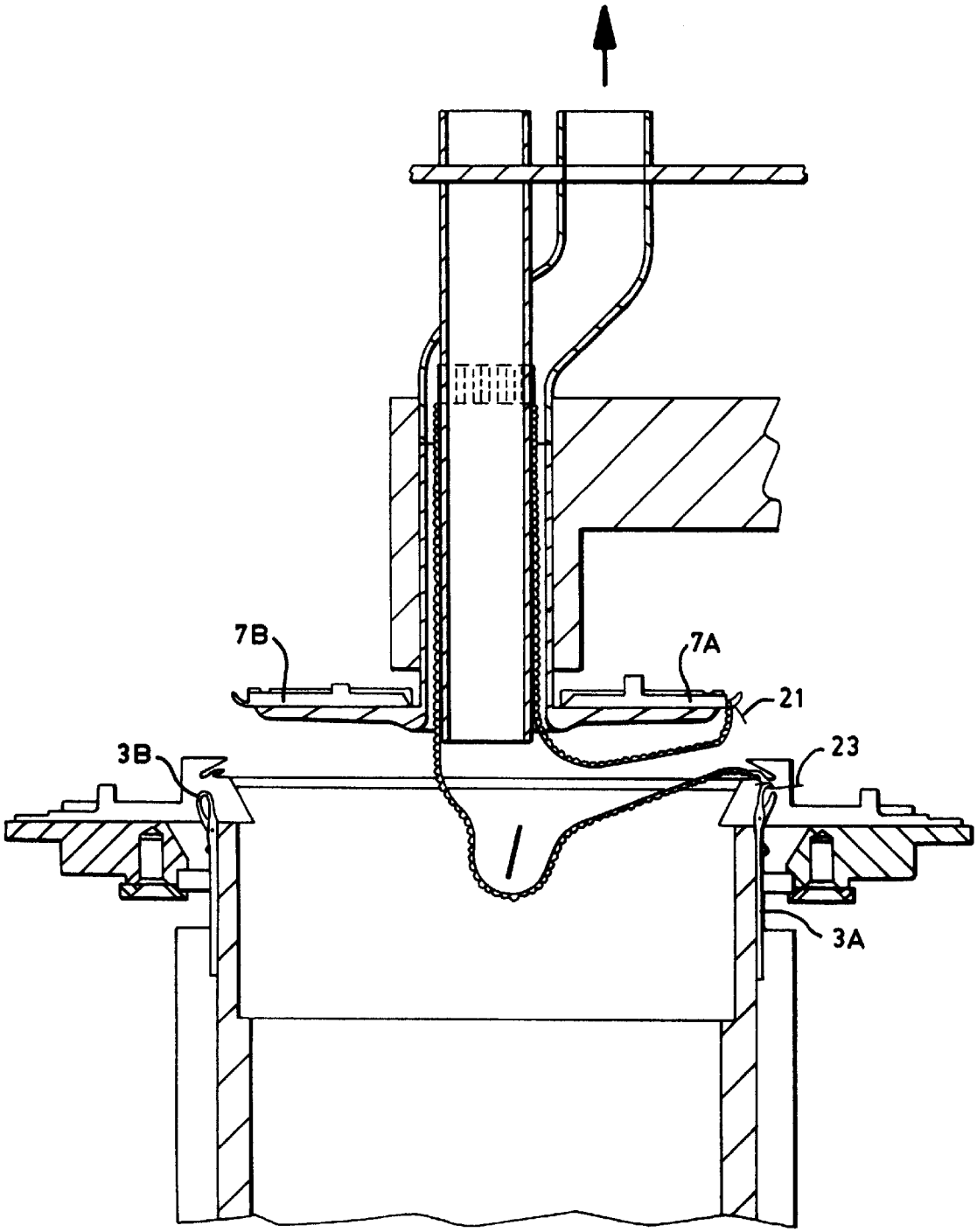
Figure 11:
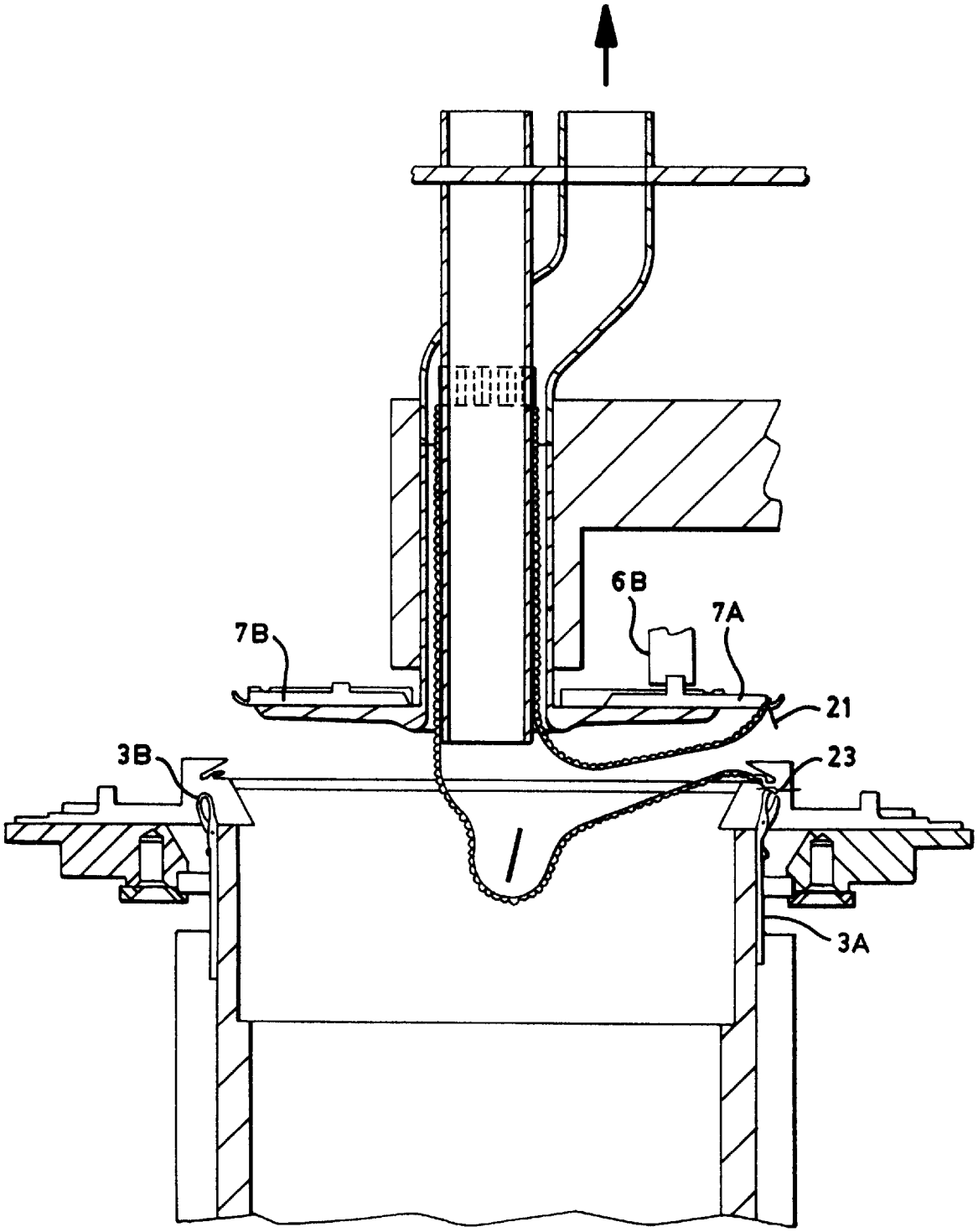

FIGS. 6 to 8 show a mechanism, marked 28 as a whole, which is designed to transfer the article on the non-run lip 23 from the arc S3B of needles 3B to the needles 3A of arc S3A. This mechanism 28 may be of any known type, including one of the mechanisms forming the subjects of previous intellectual property documents by the same proprietor; in particular, FIGS. 6 to 8 schematically show the mechanism 28 of the type that forms the subject-matter of an Italian intellectual property document filed on Jan. 31, 1996 (Application FI96/A/13) entitled: "Method and double-cylinder circular machine for forming ribbed socks or the like." This mechanism in particular comprises as active elements two pushers 30 and a plate 31, which correspond to the pushers 65 and 67 and plate 69 of the abovementioned document, which forms an integral part of the present description. This illustrated mechanism 28, or other functionally equivalent mechanisms, are used to push the completed fabric with its non-run lip 23 progressively onto the path of the fabric-free needles 3A of the arc S3A, to be engaged by these needles 3A when they are raised. The effect is to transfer the fabric, formed by the needles 3B, in such a way that this fabric is engaged along the lip 23 by the needles 3A. FIGS. 7 and 8 show the transfer operation effected by the mechanism 28 and in particular by the pushers 30; FIG. 7 shows the transferred lip 23 above the needles 3A (carrying no fabric) of the arc S3A, and in FIG. 8 the needles 3A are progressively lifted—that is, one after the other—to engage the fabric immediately inside or actually on the non-run lip 23. Once the fabric has been picked up around the lip 23 on the needles 3A, the situation is as shown in FIG. 9 in which the fabric for the toe P and that of the non-run lip 23 is picked up by the needles 3A which pass through the fabric and draw it down as they descend, as shown in FIG. 10. In this way the lip 21 is kept engaged on the hooks 7A as shown in FIGS. 4 to 10.

Figure 12:
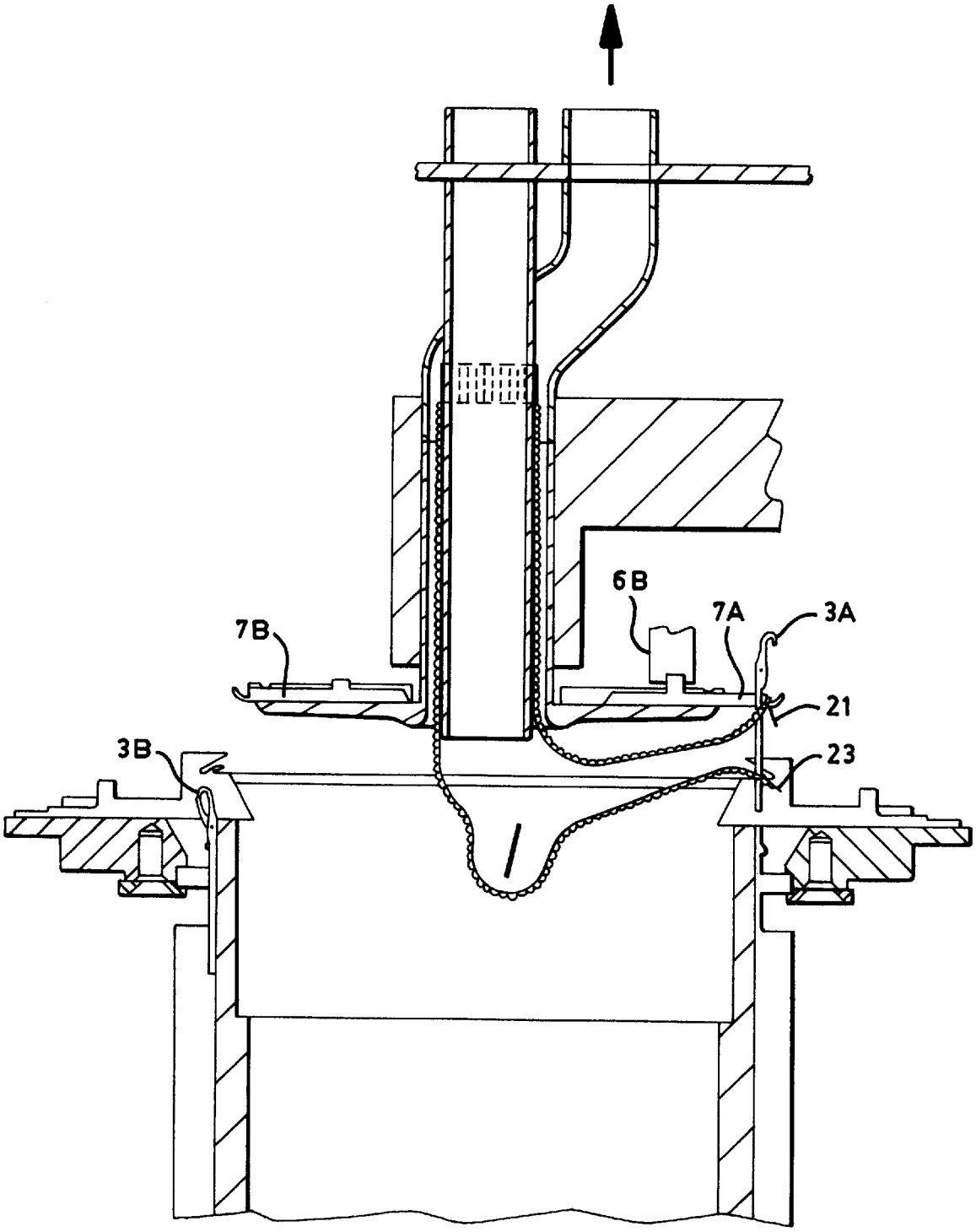
Figure 13:
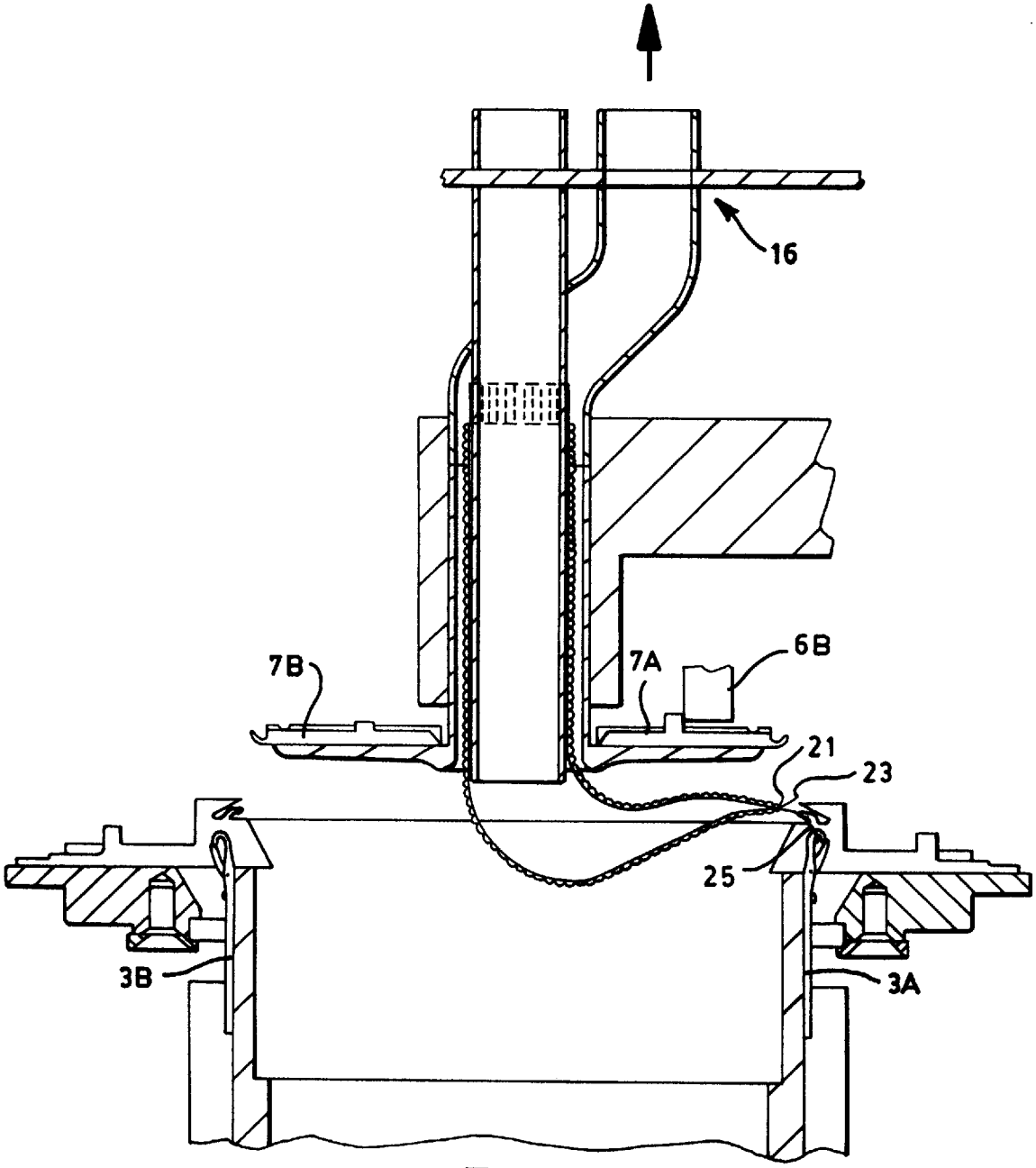

From the position of FIG. 10, a radial centrifugal movement of the hooks 7A of the arc S7A carries the non-run lip 21 out over the semicircle S3A of the needles 3A, so that the subsequent lifting of the needles 3A picks up the fabric adjacent to the said non-run lip 21 as shown in FIG. 12. As the needles 3A move down from the position of FIG. 12, and as yarn is fed to the said needles 3A, the fabric formed by the needles 3A is joined to the fabric formed by the needles 3B and the two non-run lips 21 and 23 are brought together, as shown in FIG. 13. The said FIG. 13 also illustrates the formation of a third non-run lip 25 obtained from the connection of the two fabrics of the two semicircles; this non-run lip 25 is again formed by the needles 3A.

Figure 14:
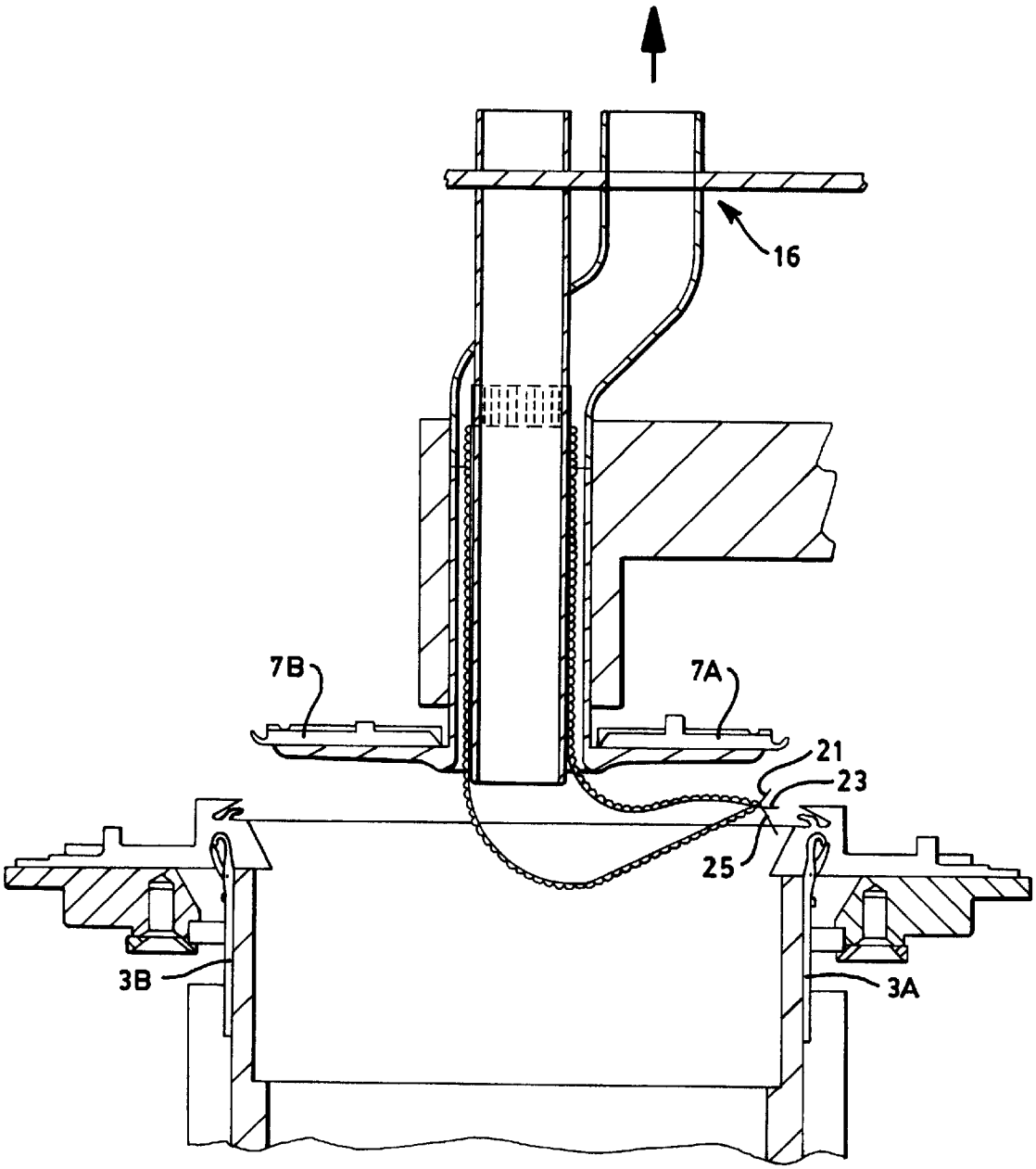
Figure 14A:
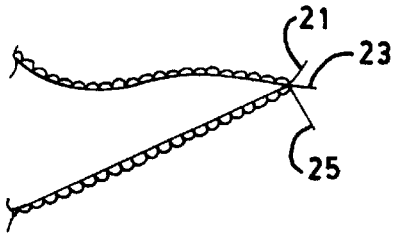
Figure 15:
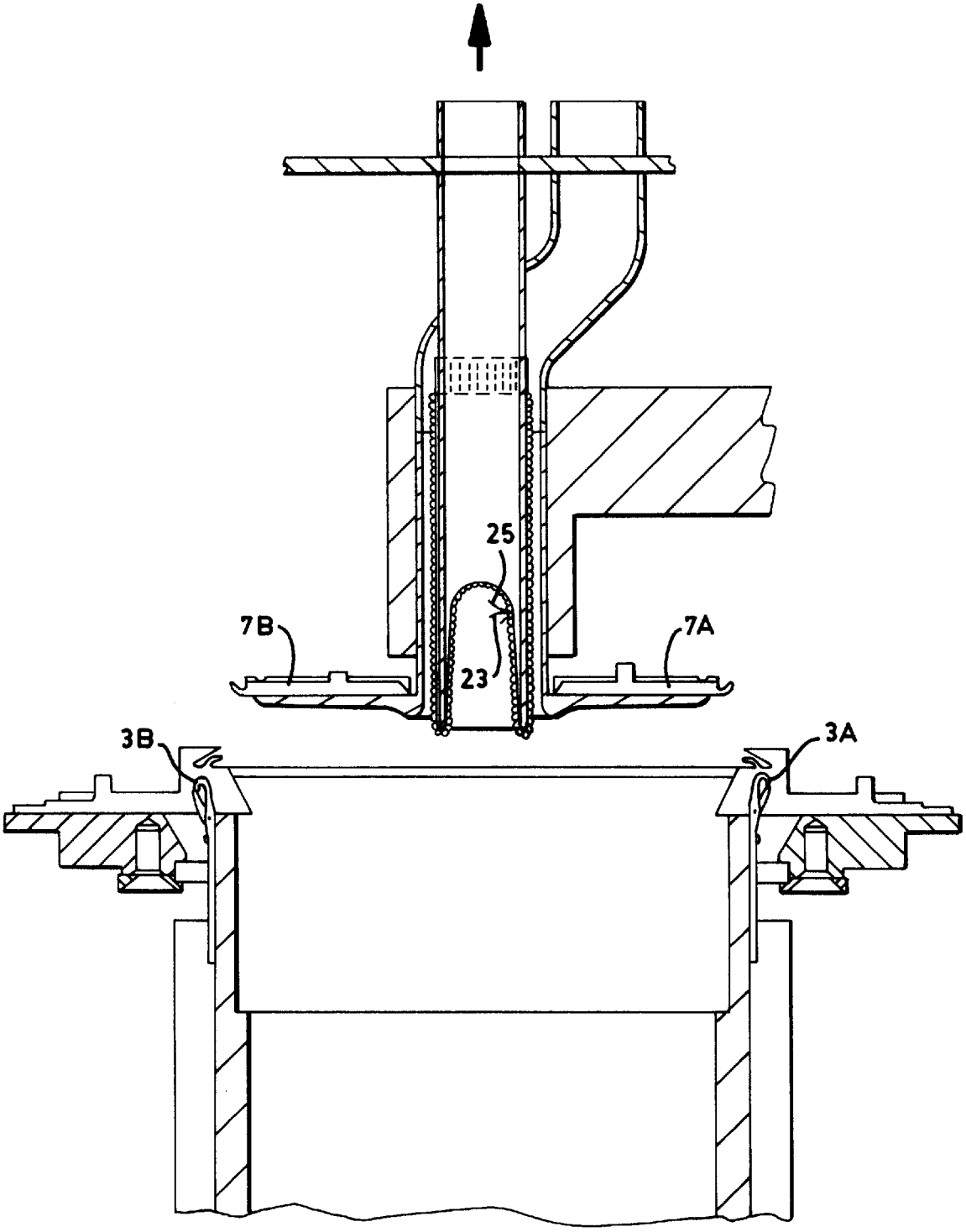
Figure 16:
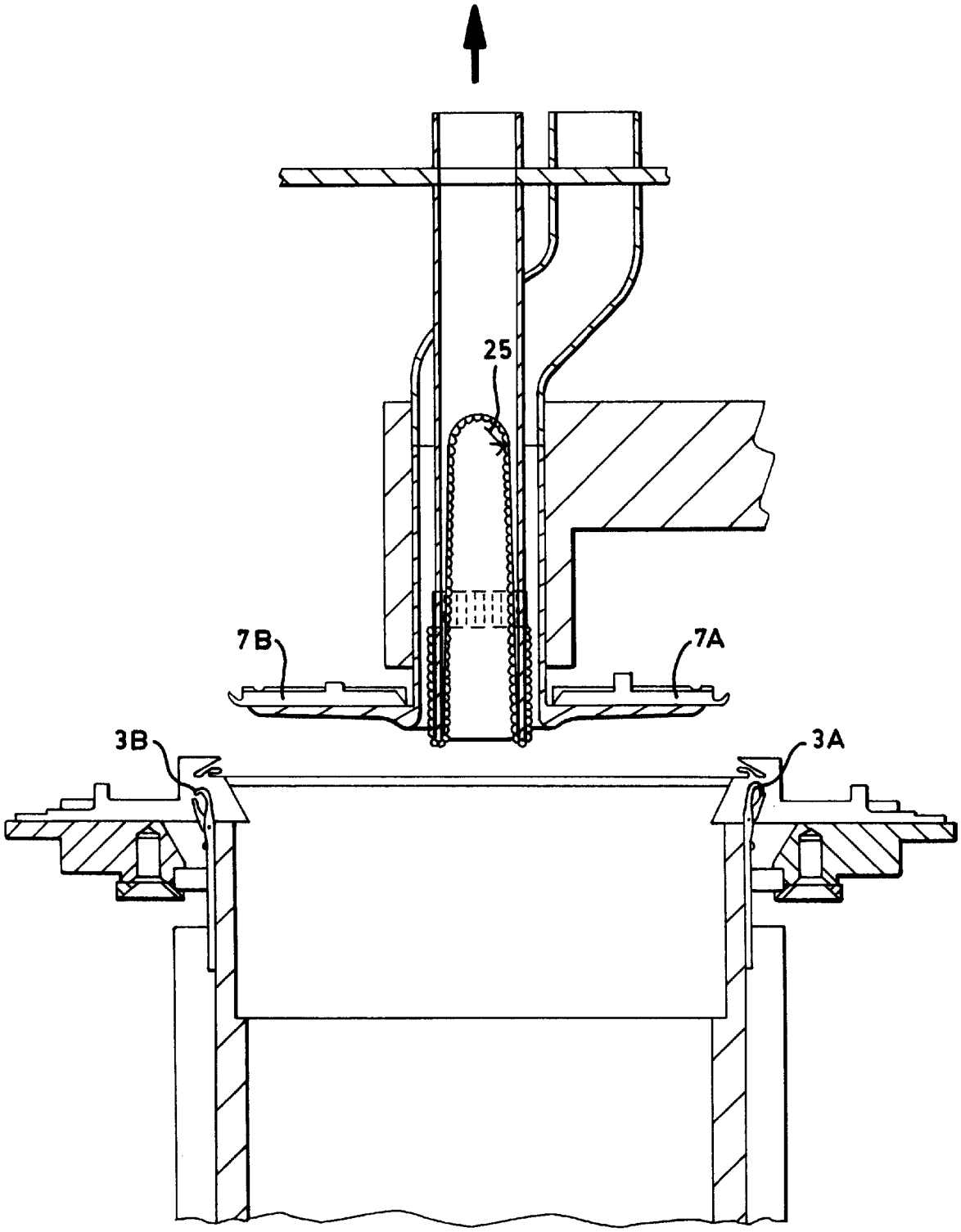

At this point the needles 3A release the said third non-run lip 25. The entire article M is thus released by the needles with its final end closed, and it is still inside the annular-sectioned pipe 14 because of the pneumatic suction, as shown in FIG. 14. The article M, the end closure of which has been performed along the lips 21, 23, 25, continues to be retained against the bottom edge 12A of the pipe 12. At this point (compare FIGS. 14 and 15) the mechanism 16 switches the suction from the annular-sectioned pipe 14 to the circular-sectioned inner pipe 12; the article M is therefore drawn by the closed end and by the pouch P into the pipe 12 as shown in FIGS. 15 and 16. By this means the sock article is turned inside out and straightened, the face D of the sock in the pipe 12 ending up on the outside and the reverse R on the inside, as shown in FIGS. 15 and 16. It should be noted that the three non-run lips 21, 23 and 25 are now on the inside, that is the reverse side R, while the face D is on the outside. The article is already ready for further processing and for packing. The article is removed from the machine in this condition through the pipe 12, which may lead into the part 14A of the pipe 14 which is above the suction switching device 16.

The suction in the annular pipe 14 during formation of the tubular fabric M and the inverting operations are such as to prevent any interference between the developing article and the mechanism 28 which is located inside the cylinder 1 below the needle working area, whatever form this mechanism 28 takes.

To prevent irregularities, and especially the formation of open eyes at the ends of the non-run lip 23, that is of the ends S3B, it is advisable for one or two needles at the ends of the said second half S3B of the cylinder needles to retain their loop during the transfer of the loops of the second half S3B of the said final end to the needles of the first half S3A of needles.

FIGS. 17 to 23 show an alternative embodiment of the tensioning system. In this embodiment, identical elements or elements equivalent to those of the version shown in FIGS. 1 to 16 are given the same reference numerals 1 to 28. The numeral 61 denotes the initial part of a suction pipe for pneumatic tensioning, set in a fixed lower position coaxial with the needle cylinder. Coaxial with the said initial part of this suction pipe 61, inside it (or outside it), is a portion 63 of suction pipe forming part of an axially mobile unit operated by an actuator 65, which may be a cylinder and piston. Above the needle cylinder and in a central through hole in the disc 7 is a portion of suction pipe 67, smaller in external diameter than the internal diameter of the portion 63 but in other respects equivalent to the pipe 12. The pipe portions 63 and 67 are for inverting the article at the conclusion of the closure of the end of the article and of its separation from the needles. Formed around the suction pipe portion 67 is an annular gap 73 defined by a pipe 75 equivalent to the pipe 12.

Figure 17:
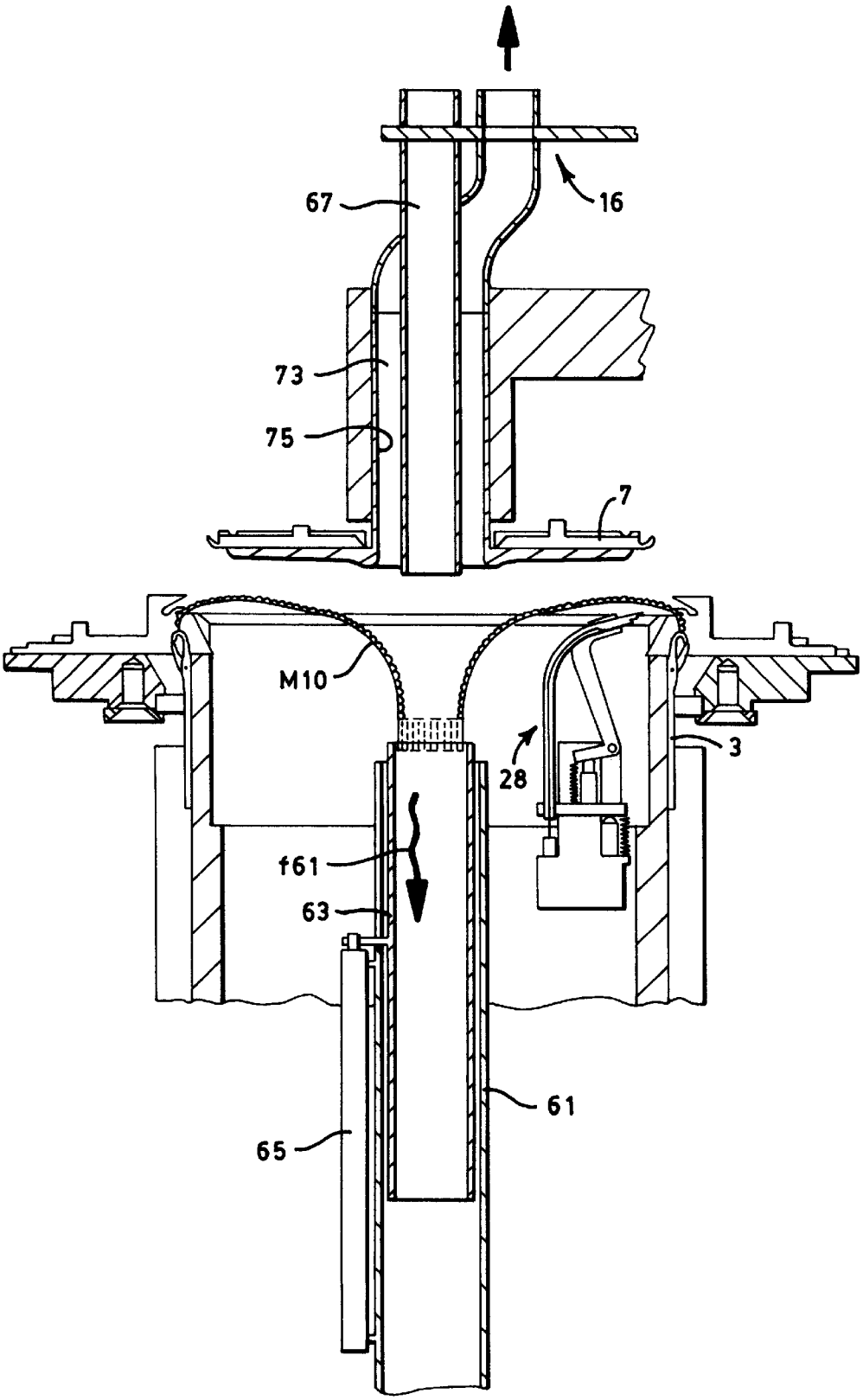
FIGS. 17 to 23 show, in various successive stages and in axial section, an alternative embodiment of the tensioning system.
Figure 18:
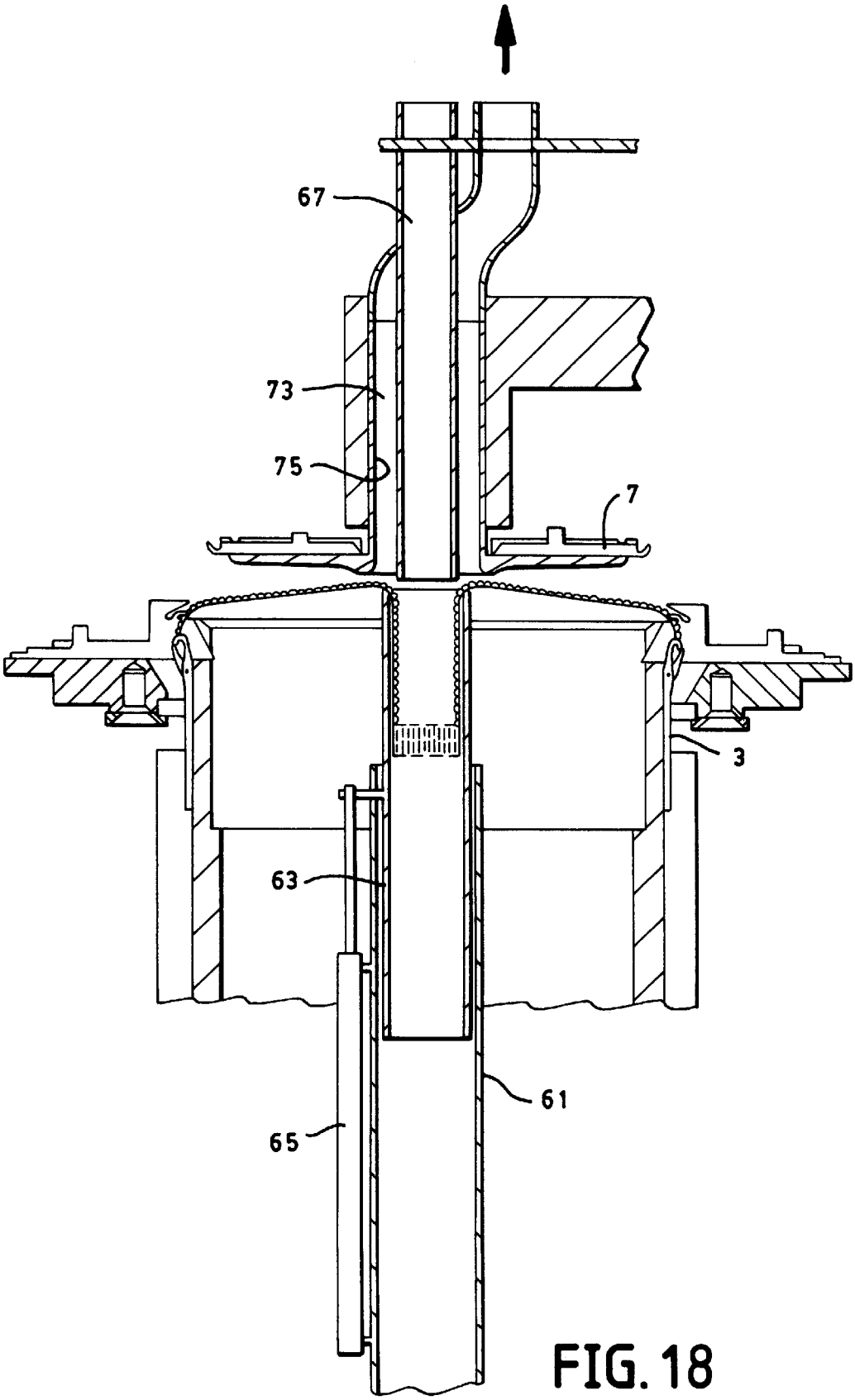
Figure 19:
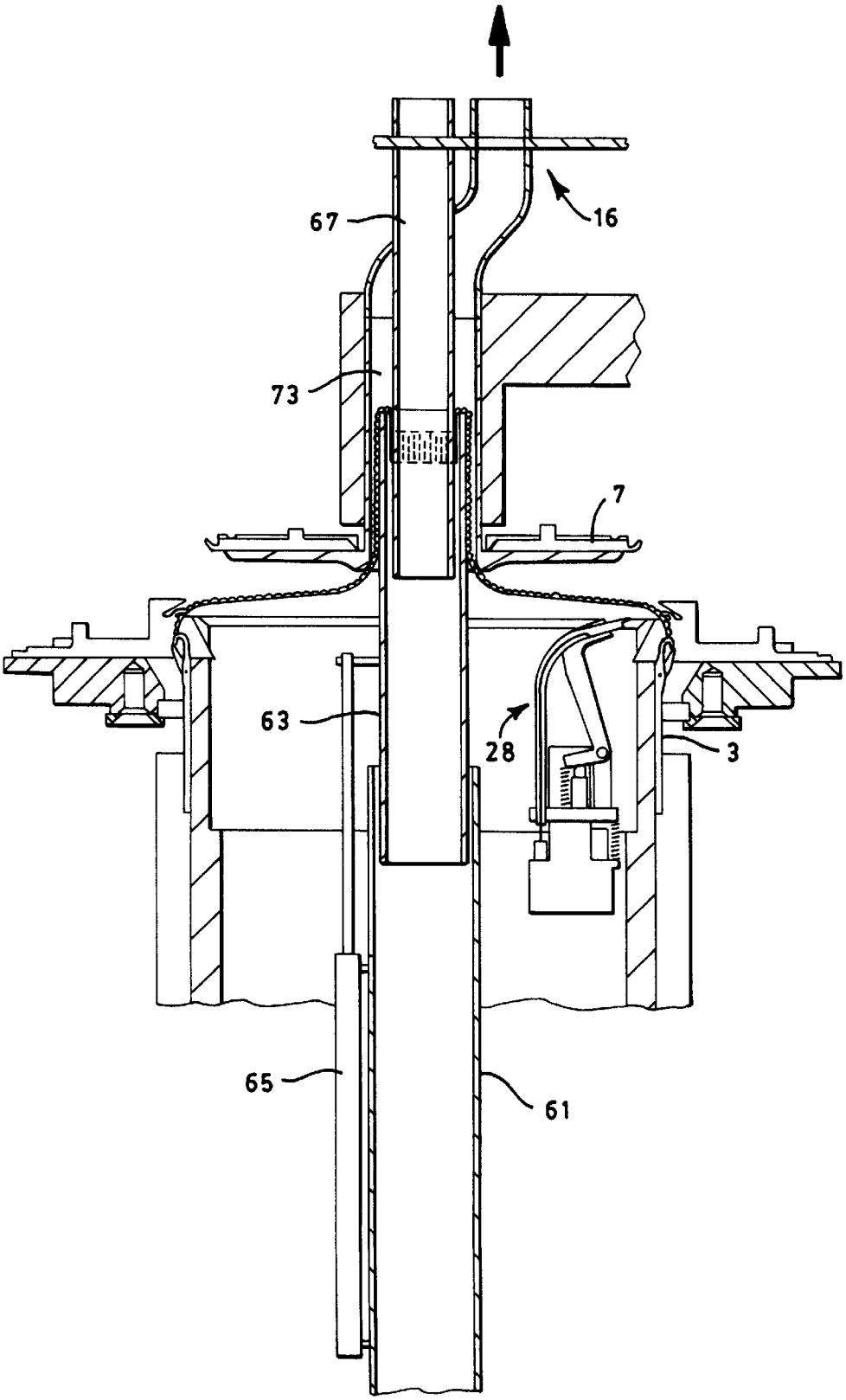

During the formation of the tubular article M10 (FIG. 17), suction is set up in the pipe 61 and hence in the initial part 63, in the direction of the arrow f61 as shown in FIG. 17. At or towards the end of the formation of the article M10, the actuator 65 raises the initial part of suction pipe 63 from the position of FIG. 17 to that of FIGS. 18 and 19, in which said initial part 63 passes into the gap 73, taking the article with it and inverting it completely (FIG. 20) around the pipe 67; the said portion 63 is then lowered, as seen in FIG. 20.

Figure 20:
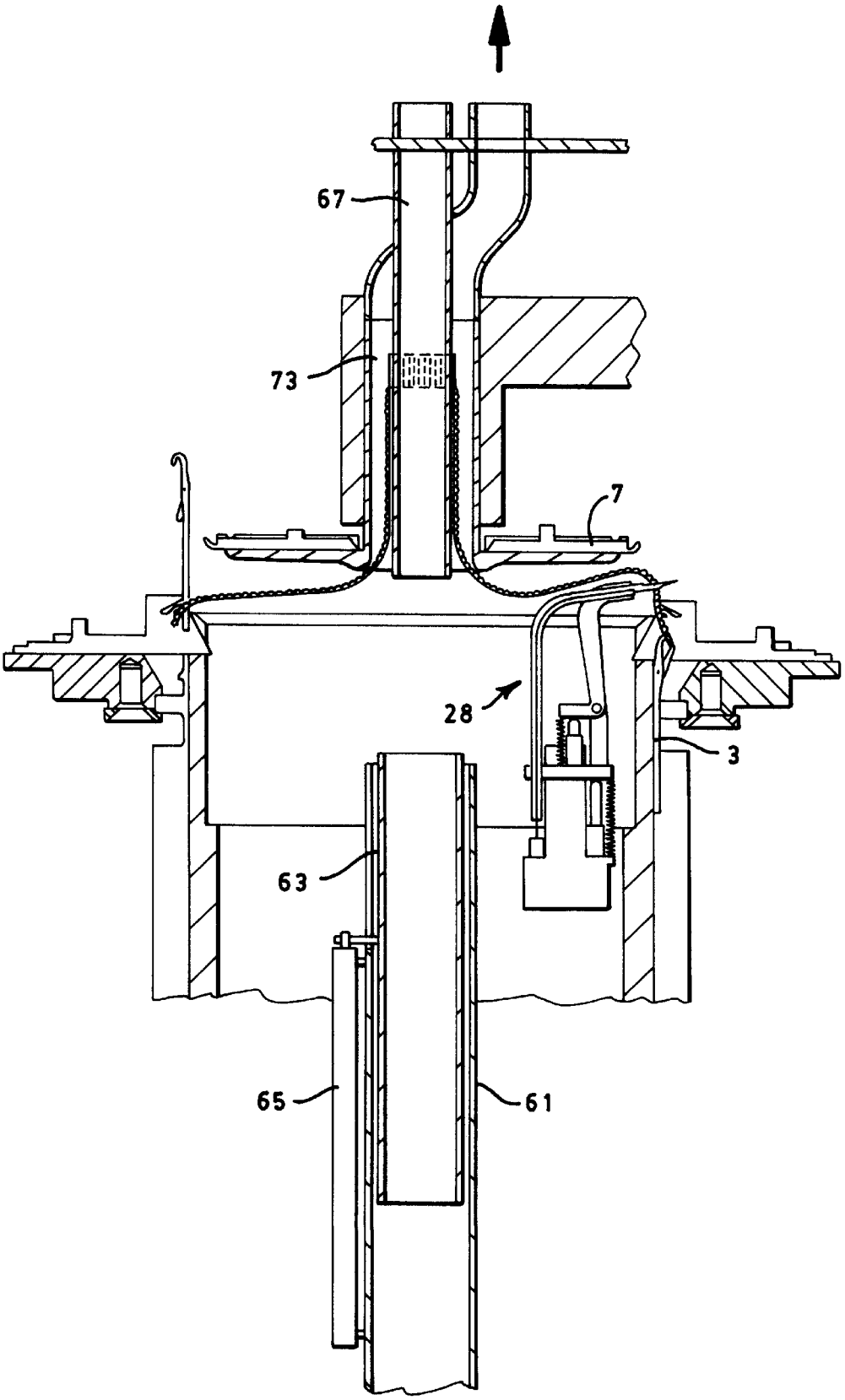
Figure 21:
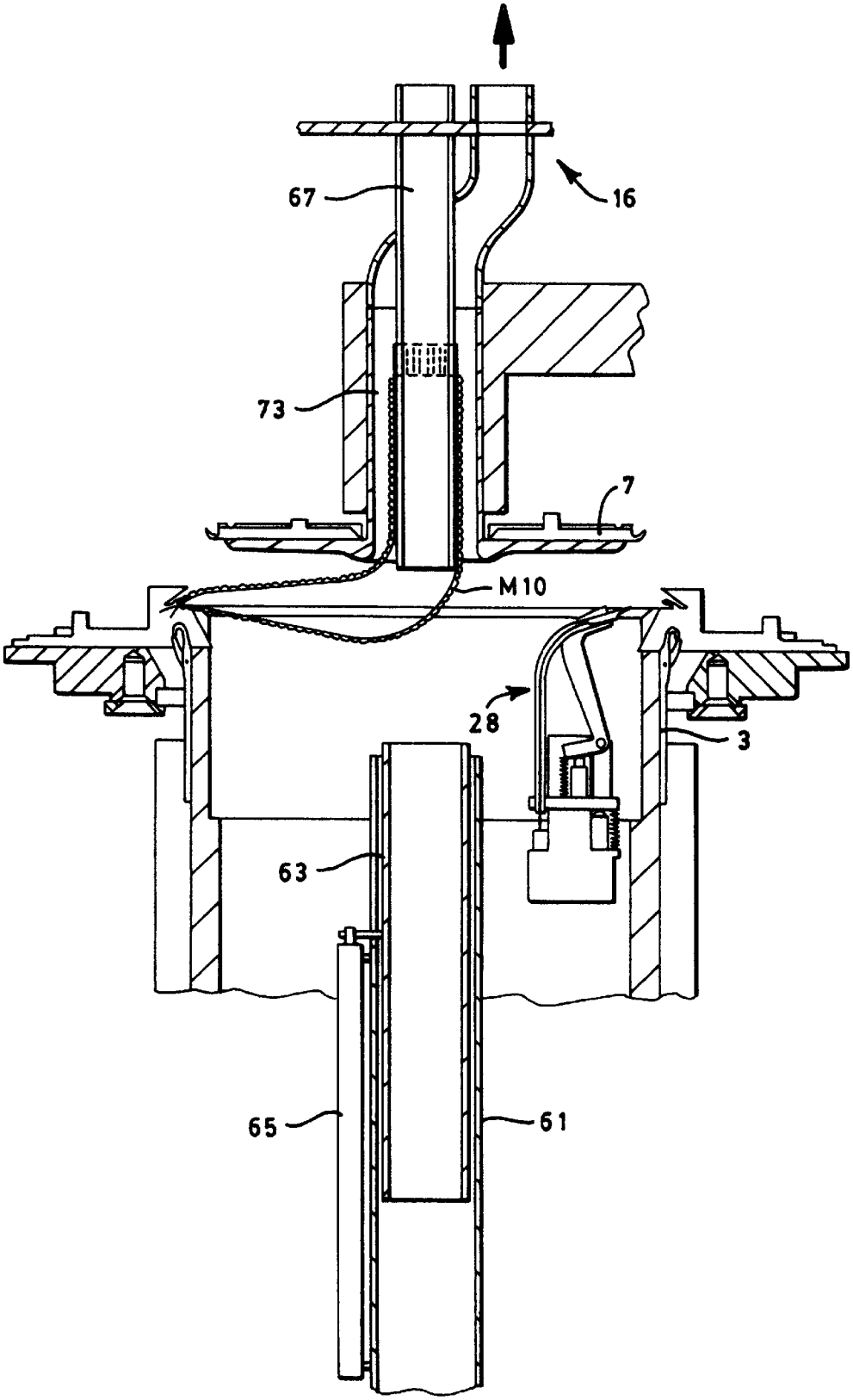
Figure 22:
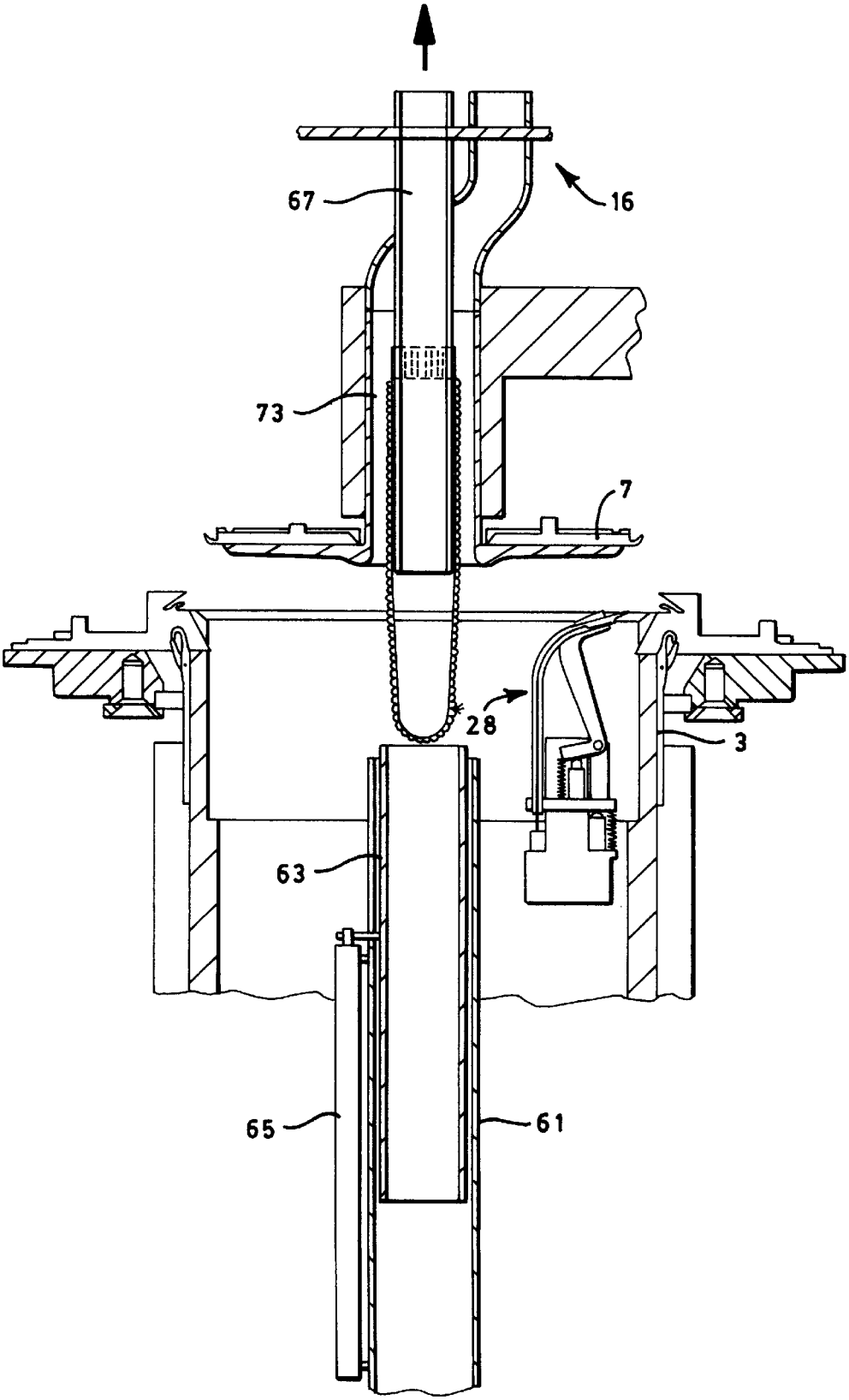
Figure 23:
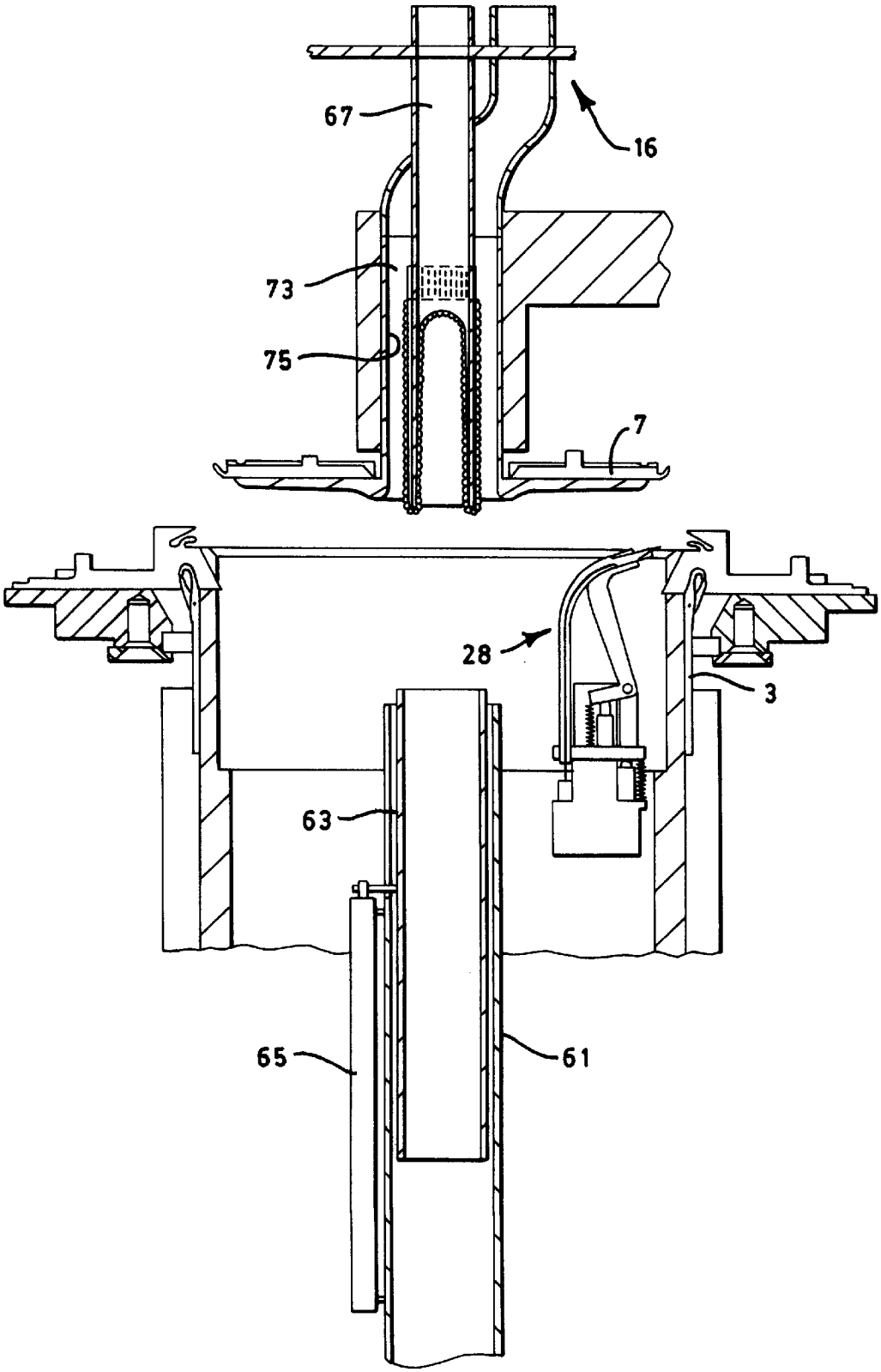

When the article has reached the position around the said portion 67, and the initial part 63 having descended still further, as shown in FIG. 20, it is possible to effect the transfer of the loops from one semicircle of needles to the opposite semicircle, in much the same way as was shown in the first embodiment, by the mechanism 28 or other equivalent mechanisms, the initial pipe part 63 being lowered far enough to leave sufficient space for this transfer operation. In the conditions illustrated in FIG. 21 (equivalent to the conditions of FIG. 13) the article M10 is closed by the needles of one semicircle at the final end of the article and this comes off the needles, reaches the approximate position of FIG. 22 and is then sucked through the pipe portion 67 and so inverted by comparison with its condition in FIGS. 21 and 22 and straightened inside the pipe formed by the portion 67. The article can be removed through the pipe 67.

Figure 24:
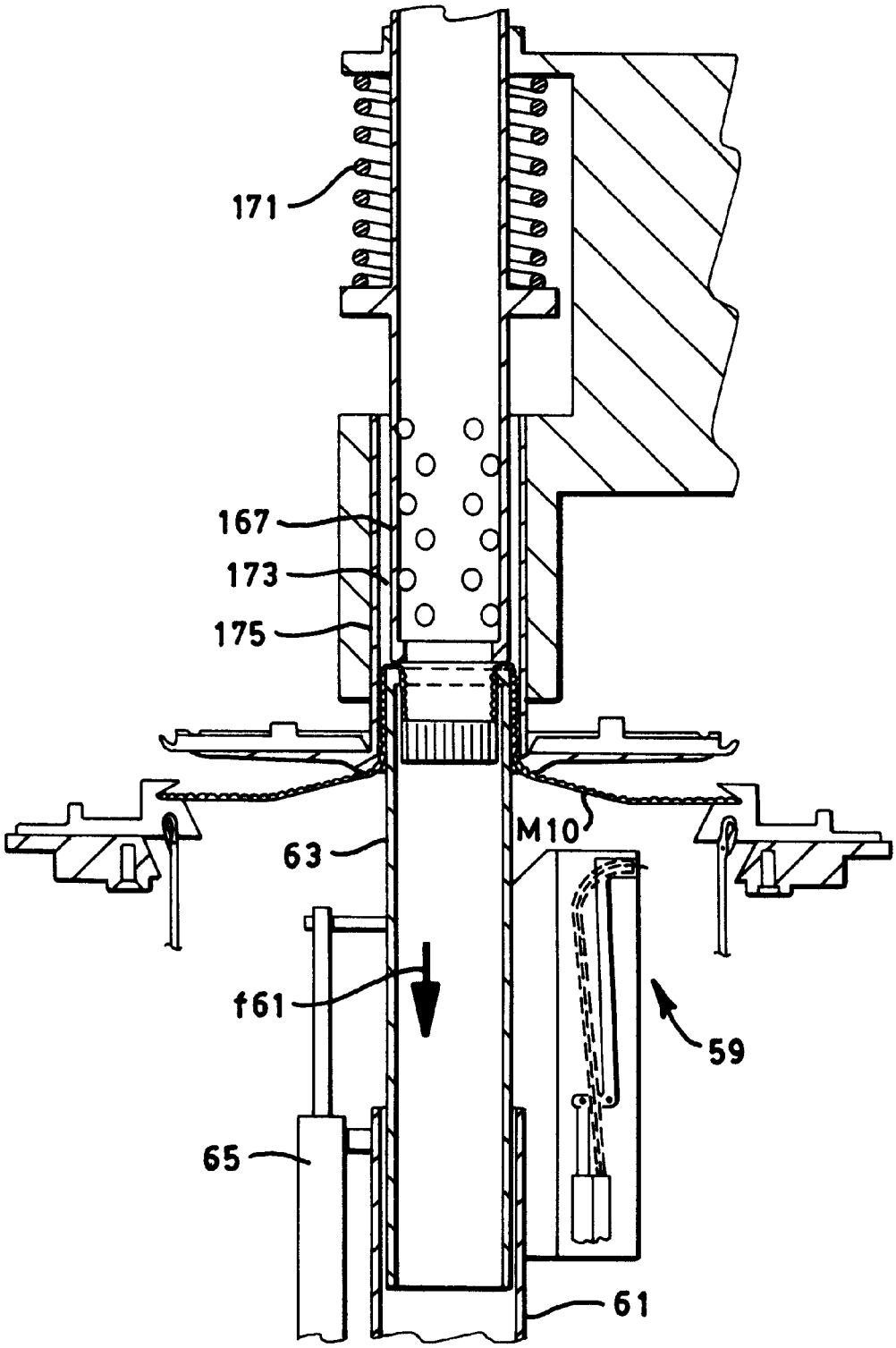
FIGS. 24 to 26 show a modification of the version of FIGS. 17 to 23.
Figure 25:
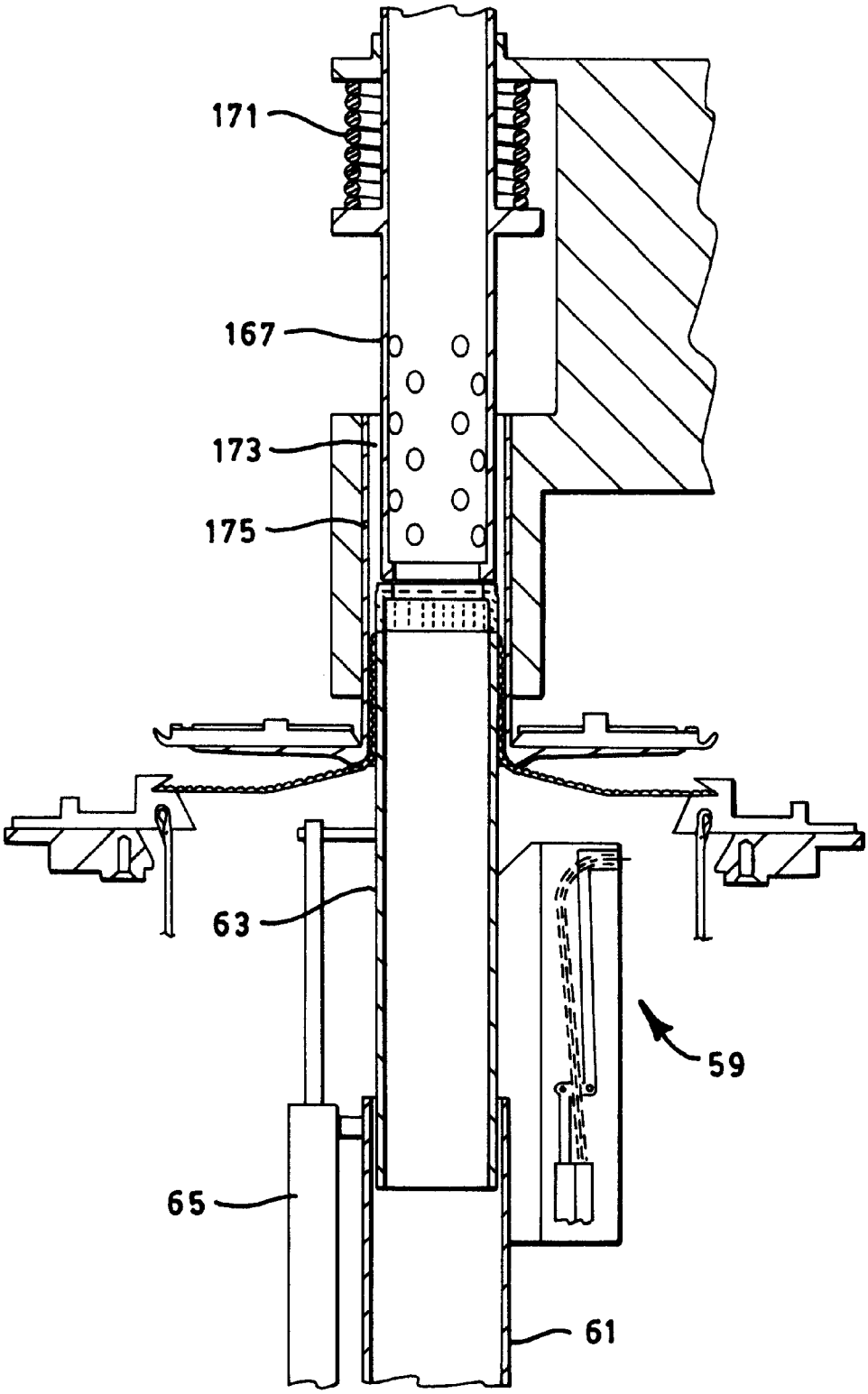
Figure 26:
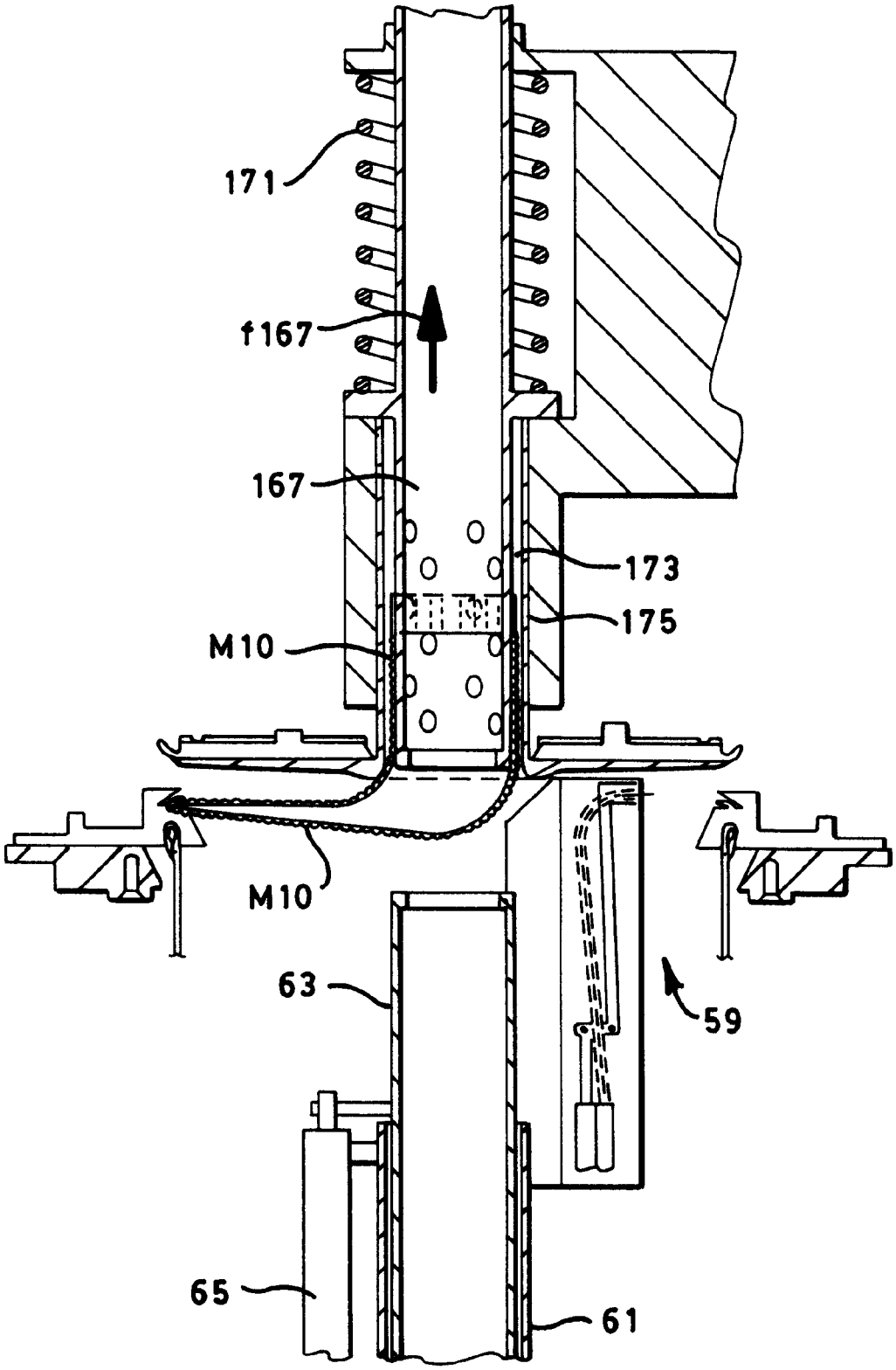

In the alternative forms shown in FIGS. 24 to 26, the references used for the description of the preceding versions again denote identical or equivalent elements; in particular it uses the components 61, 63 and 65. Above the needle cylinder and in a central through hole in the disc 5 is a suction pipe portion 167 that is also axially mobile (like the portion 63) and is acted on by a spring 171 tending to push it down towards the pipe portion 63 to a stop position (see FIG. 26). The suction pipe portions 63 and 167 are of approximately equal dimensions in cross-section and are intended to bring about the inverting of the article once the end of the article is closed and the article is separated from the needles. Around the pipe 167 is a gap 173 defined by a skirt 175 surrounding the said pipe portion 167.

During the forming of the tubular article M10, suction is set up in the pipe 61 (as in FIG. 17) and hence in the initial part 63. At or towards the end of the formation of the article M10, the actuator 65 lifts the initial suction pipe part 63 from the position corresponding to that of FIG. 17 to that shown in FIG. 24, in which the upper edge of the said initial part 63 is in contact with the lower edge of the suction pipe portion 167, which is held down by the spring 171 against the stop defined by, for example, the upper end of the skirt 175. The article M10 is pulled up over the top edge of the initial suction pipe part 63 as the initial suction pipe part 63 continues to rise, the upper suction pipe portion 167 also rises, against the action of the spring 171, reaching the position of FIG. 24 and onto that of FIG. 25. In FIG. 25 it will be seen that because of the lifting of the initial suction pipe part 63, the article M10 has come out of the said initial part 63 into the gap 173 and is now on the outside of the said initial part 63. When the initial pipe part 63 is next lowered, the pipe portion 167 is also gradually lowered until it is once again in its stop position. During the lowering of the components 63 and 167, with the downward suction (arrow f61) off and upward suction in the direction of arrow f167 on, the article is transferred around the pipe portion 167. It is under these conditions that the toe closing process is continued at the conclusion of the formation of the article, as described with reference to FIGS. 20 to 23.

It will be understood that the drawing is only indicative and is no more than a practical demonstration of the invention, it being possible for said invention to be varied as regards its shapes and arrangements without thereby departing from the scope of the concept underlying said invention. The presence of any reference numerals in the appended claims is for the purpose of facilitating the reading of the claims with reference to the description and drawing, and does not limit the scope of protection represented by the claims.

What is claimed is:

1. A method for closure of an end of a tubular fabric, the method comprising the steps of:

operating a knitting cylinder with first and second semicircles of needles to form the tubular article;

providing a hook disk with a plurality of hooks cooperating with said needles of said knitting cylinder to form the end of the tubular fabric;

loading the hooks with loops of the tubular fabric from the first semicircle of needles;

forming a first non-run lip in the tubular fabric with the first semicircle of needles;

releasing the loops of the fabric from the first semicircle of needles;

forming a second non-run lip with the second semicircle of needles;

releasing the loops of the fabric from said second semicircle of needles;

transferring the second non-run lip to the first semicircle of needles;

raising said needles to engage the fabric along the second non-run lip;

moving the hooks radially out;

operating the first semicircle of needles to take the fabric from the hooks and join the fabric from the hooks to the fabric already engaged by the first semicircle of needles to form a third non-run lip;

releasing the third non-run lip from the first semicircle of needles.

2. A machine for forming an end in a tubular fabric, the machine comprising:

a knitting cylinder with first and second semicircles of needles;

a hook disk with a plurality of hooks cooperating with said needles of said knitting cylinder to form the end of the tubular fabric;

disk drawing means for drawing the tubular fabric to a side of said hook disk diametrically opposite from said knitting cylinder, said disk drawing means includes a pipe passing through said hook disk for pneumatic suction of the tubular article;

a transfer mechanism for transferring loops of the fabric from said second semicircle of needles to said first semicircle of needles;

hook operating means radially operating said hooks to remove and return loops of the tubular fabric from and to said first semicircle of needles.

3. A machine for forming an end in a tubular fabric, the machine comprising:

a knitting cylinder with first and second semicircles of needles;

a hook disk with a plurality of hooks cooperating with said needles of said knitting cylinder to form the end of the tubular fabric;

disk drawing means for drawing the tubular fabric to a side of said hook disk diametrically opposite from said knitting cylinder;

a transfer mechanism for transferring loops of the fabric from said second semicircle of needles to said first semicircle of needles;

hook operating means radially operating said hooks to remove and return loops of the tubular fabric from and to said first semicircle of needles.

4. The machine according to claim 3, further comprising:

a pipe passing through said hook disc for pneumatic suction of the tubular fabric.

5. The machine according to claim 3, further comprising:

inner and outer concentric suction pipes which pass through said hook disc;

means for switching suction from one of said suction pipes to another, in order to produce tensioning in said outer suction pipe and then invert the tubular fabric by transferring the tubular fabric from said outer pipe to said inner suction pipe.

6. The machine according to claim 3, further comprising:

a pneumatic suction tensioning pipe with an initial portion capable of being raised and lowered;

a tubular portion which acts in combination with the said initial portion—when raised—to straighten the tubular fabric and then remove the tubular fabric pneumatically.

7. The machine according to claim 6, wherein:

said tubular portion forms part of a suction pipe capable of being pushed up by said initial portion of said tensioning pipe.

8. The machine according to claim 2, further comprising two concentric suction pipes, an inner circular-sectioned pipe and an outer annular-sectioned pipe which pass through the disc; and means for switching the suction from one of said two pipes to the other, in order to produce tensioning in said outer pipe and the invert the article of tubular fabric by transferring it from said outer pipe to said inner pipe.

9. The machine according to claim 2, further comprising a pneumatic suction tensioning pipe with an initial portion capable of being raised and lowered; and a tubular portion which acts in combination with the said initial part—when raised—to straighten the tubular fabric and then remove it pneumatically.

10. The machine according to claim 4, wherein said tubular portion forms part of another suction pipe capable of being pushed up by said initial portion of the tensioning pipe.

11. The method according to claim 1, wherein the tubular fabric is tensioned to straighten pneumatically in a pneumatic suction pipe passing through the hook disc.

12. The method according to claim 1, wherein the tubular fabric is tensioned pneumatically in an annular-sectioned suction pipe surrounding an inner pipe, and at conclusion of closure of the end of the tubular article, suction is switched from the annular-sectioned outer pipe to the inner pipe, so that the tubular article closed and released by the needles is sucked with the three non-run lips inside the article, which is thus straightened out.

13. The method according to claim 1, wherein the tubular fabric is drawn upwards after being pneumatically tensioned downwards, by edge of an initial part of a pneumatic tensioning pipe.

14. The method according to claim 1, wherein one of the needles at an of said second semicircle of needles retain a loop during transfer of loops from the second semicircle of needles to the first semicircle of needles.

15. The machine according to claim 2, further comprising a pneumatic suction tensioning pipe with an initial portion capable of being raised and lowered; and a tubular portion which acts in combination with said initial part—when raised—to straighten the tubular fabric and then remove the tubular fabric pneumatically.

16. The method according to claim 11, wherein the tubular fabric is tensioned pneumatically in an annular-sectioned suction pipe surrounding an inner pipe, and at conclusion of closure of the end of the tubular article, suction is switched from the annular-sectioned outer pipe to the inner pipe, so that the tubular article closed and released by the needles is sucked with the three non-run lips into an inside of the article, which is thus straightened out.

17. The method according to claim 11, wherein the tubular fabric is drawn upwards after being pneumatically tensioned downwards, by an edge of an initial part of a pneumatic tensioning pipe.

18. The method according to claim 11, wherein one of the needles at an end of said second semicircle of needles retain a loop during the transfer of the loops of the second semicircle of needles to the first semicircle of needles.

* * * * *